US009971293B2

(12) United States Patent
Monden et al.

(10) Patent No.: US 9,971,293 B2
(45) Date of Patent: May 15, 2018

(54) IMAGE FORMING APPARATUS INCLUDING OPTICAL SENSOR

(71) Applicant: CANON KABUSHIKI KAISHA, Tokyo (JP)

(72) Inventors: Noriyuki Monden, Numazu (JP); Takuya Mukaibara, Susono (JP); Kazushi Ino, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/295,097

(22) Filed: Oct. 17, 2016

(65) Prior Publication Data

US 2017/0131657 A1 May 11, 2017

(30) Foreign Application Priority Data

Nov. 6, 2015 (JP) ..... 2015-218800

(51) Int. Cl.
*G03G 15/00* (2006.01)

(52) U.S. Cl.
CPC ..... *G03G 15/556* (2013.01); *G03G 15/5058* (2013.01)

(58) Field of Classification Search
CPC ..... G03G 15/556; G03G 15/5058
See application file for complete search history.

(56) References Cited

U.S. PATENT DOCUMENTS 4,313,671 A * 2/1982 Kuru ..... G03G 15/0855 118/688
4,989,985 A * 2/1991 Hubble, III ..... G01N 21/55 250/341.8

(Continued)

FOREIGN PATENT DOCUMENTS

JP 10-221902 A 8/1998
JP 2006-208266 A 8/2006

(Continued)

OTHER PUBLICATIONS

U.S. Appl. No. 15/291,445, Takuya Mukaibara, Takashi Fukuhara, Kazushi Ino, Naoki Nishimura, Keisuke Nakano, filed Oct. 12, 2016.

(Continued)

*Primary Examiner* — G. M. Hyder

(74) *Attorney, Agent, or Firm* — Fitzpatrick, Cella, Harper & Scinto

(57) ABSTRACT

A toner detection unit includes an LED and a light receiving element that outputs a current in accordance with a received light amount. A current/voltage converter circuit converts the current outputted from the light receiving element into a voltage and outputs the voltage. A voltage amplifier circuit amplifies a difference between the voltage outputted from the converter circuit and a reference voltage and outputs the amplified difference as a voltage corresponding to the received light amount. A microcomputer measures the voltage outputted from the voltage amplifier circuit by causing the LED to emit light, under a measurement condition under which the reflected light is not incident on the light receiving element through an opening formed in a housing of the toner detection unit, and adjusts the reference voltage used in the voltage amplifier circuit based on the obtained measured voltage.

15 Claims, 12 Drawing Sheets

(56) References Cited

U.S. PATENT DOCUMENTS

| | | | | |
|---|---|---|---|---|
| 5,083,161 | A * | 1/1992 | Borton | G01N 21/55 250/341.8 |
| 5,233,387 | A * | 8/1993 | Kuwabara | G03B 27/32 355/408 |
| 5,519,497 | A * | 5/1996 | Hubble, III | G01N 21/55 356/445 |
| 5,678,132 | A * | 10/1997 | Shiba | G03G 15/5058 399/59 |
| 6,628,398 | B1 * | 9/2003 | Denton | G01N 21/474 356/445 |
| 7,751,741 | B2 | 7/2010 | Hirai | |
| 9,049,313 | B2 | 6/2015 | Mukaibara et al. | |
| 9,213,290 | B2 | 12/2015 | Koyama et al. | |
| 9,244,415 | B2 | 1/2016 | Yamaguchi et al. | |
| 2008/0292360 | A1 * | 11/2008 | Hirai | G01N 21/55 399/220 |
| 2010/0002266 | A1 * | 1/2010 | Takahashi | G03G 15/5062 358/3.06 |
| 2013/0216245 | A1 * | 8/2013 | Hoshi | G03G 15/0189 399/45 |
| 2013/0272740 | A1 | 10/2013 | Nakagawa et al. | |
| 2015/0211992 | A1 | 7/2015 | Ishizumi et al. | |
| 2015/0278662 | A1 | 10/2015 | Hosoya et al. | |
| 2015/0293488 | A1 | 10/2015 | Mukaibara et al. | |
| 2016/0209794 | A1 * | 7/2016 | Oba | G03G 15/5029 |
| 2017/0131670 | A1 * | 5/2017 | Ino | G03G 15/0178 |

FOREIGN PATENT DOCUMENTS

| | | | |
|---|---|---|---|
| JP | 2011-112988 | A | 6/2011 |
| JP | 2013-191835 | A | 9/2013 |
| JP | 2015-141113 | A | 8/2015 |
| JP | 2015-215441 | A | 12/2015 |

OTHER PUBLICATIONS

U.S. Appl. No. 15/297,381, Kazushi Ino, Takuya Mukaibara, Naoki Nishimura, Takashi Fukuhara, Osamu Nagasaki, filed Oct. 19, 2016.

* cited by examiner

FIG. 9

| $R_2$, $R_4$ [kΩ] | Av |
|---|---|
| 10 | 1 |
| 10.5 | 1.05 |
| 11.1 | 1.11 |
| 11.8 | 1.18 |
| 12.5 | 1.25 |
| 13.3 | 1.33 |
| 14.3 | 1.43 |
| 15.4 | 1.54 |
| 16.7 | 1.67 |
| 18.2 | 1.82 |
| 20.0 | 2 |
| 22.2 | 2.22 |
| 25.0 | 2.5 |
| 28.6 | 2.86 |
| 33.3 | 3.33 |
| 40 | 4 |
| 50 | 5 |
| 66.7 | 6.67 |
| 100 | 10 |
| 200 | 20 |

IMAGE FORMING APPARATUS INCLUDING OPTICAL SENSOR

BACKGROUND OF THE INVENTION

Field of the Invention

The present invention relates to an image forming apparatus including an optical sensor for receiving, by a light receiving element, reflected light of light emitted from a light emitting element to detect a detection target.

Description of the Related Art

In recent years, in electrophotographic image forming apparatuses, a tandem type which is a configuration in which a photosensitive member is arranged for each color to accelerate printing speed has become mainstream. In a tandem type image forming apparatus, a color misregistration amount is determined by forming a detection image (a toner image) which is a test pattern for detecting a color misregistration amount on an intermediate transfer belt, for example, and then irradiating light onto the detection image and detecting light reflected therefrom by an optical sensor. Also, a determination of a density of a toner (a density of an image) using such an optical sensor has been performed. In Japanese Patent Laid-Open No. H10-221902, a technique is disclosed in which a diffused reflection light and a specular reflection light of light irradiated on a toner image are respectively received by individual light receiving units (sensors), and based on the received light amounts, the density of toner is detected. By virtue of such a technique, it is possible to improve precision of detection of toner by an optical sensor even if toner of a plurality of colors used in the image forming apparatus has reflection characteristics that differ with respect to the light used by the optical sensor.

In an optical sensor of the foregoing type, generally, in addition to providing an aperture for limiting (narrowing) light that the light emitting element emits, that kind of aperture is also provided for the light receiving elements that respectively receive specular reflection light and diffused reflection light in order to separate the specular reflection light and the diffused reflection light. Surface-mounted type optical sensors in which an optical element is mounted directly on a surface of a circuit board are disclosed as such kind of optical sensors in Japanese Patent Laid-Open No. 2006-208266 and in Japanese Patent Laid-Open No. 2013-191835.

In Japanese Patent Laid-Open No. 2006-208266, an optical unit holder is attached to a circuit board on which a light emitting element and two light receiving elements are directly mounted, and three polarization filters respectively corresponding to the light emitting element and the two light receiving elements are arranged on an outside surface of the optical unit holder. However, when a plurality of polarization filters are used in this way, it leads to an increase in apparatus cost, and a reduction in productivity. Meanwhile, in Japanese Patent Laid-Open No. 2013-191835, a housing having an opening (a light guiding path) that functions as an aperture corresponding to each optical element (the light emitting element and the two light receiving elements) is configured such that light shielding walls that configure the openings are inserted in a slit hole arranged in a circuit board. This improves a light-shielding property in an optical sensor configured by mounting each optical element on a surface of the circuit board.

However, in the optical sensor described in Japanese Patent Laid-Open No. 2013-191835, it is necessary to arrange the light emitting element and the two light receiving elements at a certain distance from each other in order to realize the housing that improves the light-shielding property. Even if it is possible to improve the light-shielding property by virtue of this kind of optical sensor configuration, the size of the optical sensor is larger in a direction in which the light emitting element and the two light receiving elements are arranged. Accordingly, it would be desirable to realize further miniaturization in the optical sensor.

Depending on a configuration for realizing miniaturization of the optical sensor, cases may occur in which the light-shielding property between the light emitting element and the light receiving elements cannot be sufficiently ensured due to a reflection of light that arises within the housing of the optical sensor. If reflected light that arises within the housing of the optical sensor is irradiated onto the light receiving element, an error that depends on a received light amount of such reflected light will occur in the detection result of the received light amounts by the light receiving elements.

SUMMARY OF THE INVENTION

The present invention was conceived in view of the above described issues. The present invention provides a technique for, in an optical sensor for receiving, by a light receiving element, reflected light of light emitted from a light emitting element, reducing an influence of reflected light that arises within a housing on a detection result of a received light amount.

According to one aspect of the present invention, there is provided an image forming apparatus, comprising: an image carrier that is rotated; an optical sensor comprising a light emitting element that irradiates light towards the image carrier, a light receiving element that outputs current in accordance with a received light amount, and a housing that is configured to guide the light emitted from the light emitting element towards the image carrier and to guide reflected light from the image carrier to the light receiving element, wherein a common opening through which the light emitted from the light emitting element and light to be incident on the light receiving elements passes is formed in the housing; a converter circuit configured to convert the current outputted from the light receiving element into a voltage and to output the voltage; an amplifier circuit configured to amplify a difference between the voltage outputted from the converter circuit and a reference voltage, and to output the difference as a voltage corresponding to the received light amount; and a control unit configured to execute a measurement of the voltage outputted from the amplifier circuit by causing the light emitting element to emit light, under a measurement condition under which the reflected light is not incident on the light receiving element through the opening, and to adjust the reference voltage used in the amplifier circuit based on a measured voltage obtained by the measurement.

According to one aspect of the present invention, there is provided an image forming apparatus, comprising: an image carrier that is rotated; an optical sensor comprising a light emitting element that irradiates light towards the image carrier, a light receiving element that outputs current in accordance with a received light amount, and a housing that is configured to guide the light emitted from the light emitting element towards the image carrier and to guide reflected light from the image carrier to the light receiving element, wherein a common opening through which the light emitted from the light emitting element and light to be incident on the light receiving elements passes is formed in the housing; a converter circuit configured to convert the current outputted from the light receiving element into a voltage and to output the voltage; an amplifier circuit configured to amplify a difference between the voltage outputted from the converter circuit and a reference voltage, and to output the difference as a voltage corresponding to the received light amount; an image formation unit configured to a first patch image of black and a second patch image of a different color to the first patch image on the image carrier; and a control unit configured to adjust an amplification factor of the amplifier circuit based on a measured voltage, for the voltage outputted from the amplifier circuit, that corresponds to the first patch image and the measured voltage that corresponds to the second patch image.

According to one aspect of the present invention, there is provided an image forming apparatus, comprising: an image carrier that is rotated; an optical sensor comprising a light emitting element that irradiates light towards the image carrier, a light receiving element that outputs an output value in accordance with a received light amount, and a housing that is configured to guide the light emitted from the light emitting element towards the image carrier and to guide reflected light from the image carrier to the light receiving element, wherein a common opening through which the light emitted from the light emitting element and light to be incident on the light receiving elements passes is formed in the housing; and a control unit configured to, based on a first output value outputted from the light receiving element by causing the light emitting element to emit light under a first measurement condition under which the reflected light is not incident on the light receiving element through the opening, adjust a reference voltage for correcting a second output value outputted from the light receiving element by causing the light emitting element to emit light under a second measurement condition under which the reflected light is incident on the light receiving element through the opening.

By virtue of the present invention, it becomes possible to reduce, in an optical sensor for receiving, by a light receiving element, reflected light of light emitted from a light emitting element, an influence of reflected light that arises within a housing on a detection result of a received light amount.

Further features of the present invention will become apparent from the following description of exemplary embodiments (with reference to the attached drawings).

BRIEF DESCRIPTION OF THE DRAWINGS

FIG. 9 illustrates an example of a relationship between resistance values of a resistor array and voltage amplification factors.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

<Overview of Image Forming Apparatus>

Figure 1:
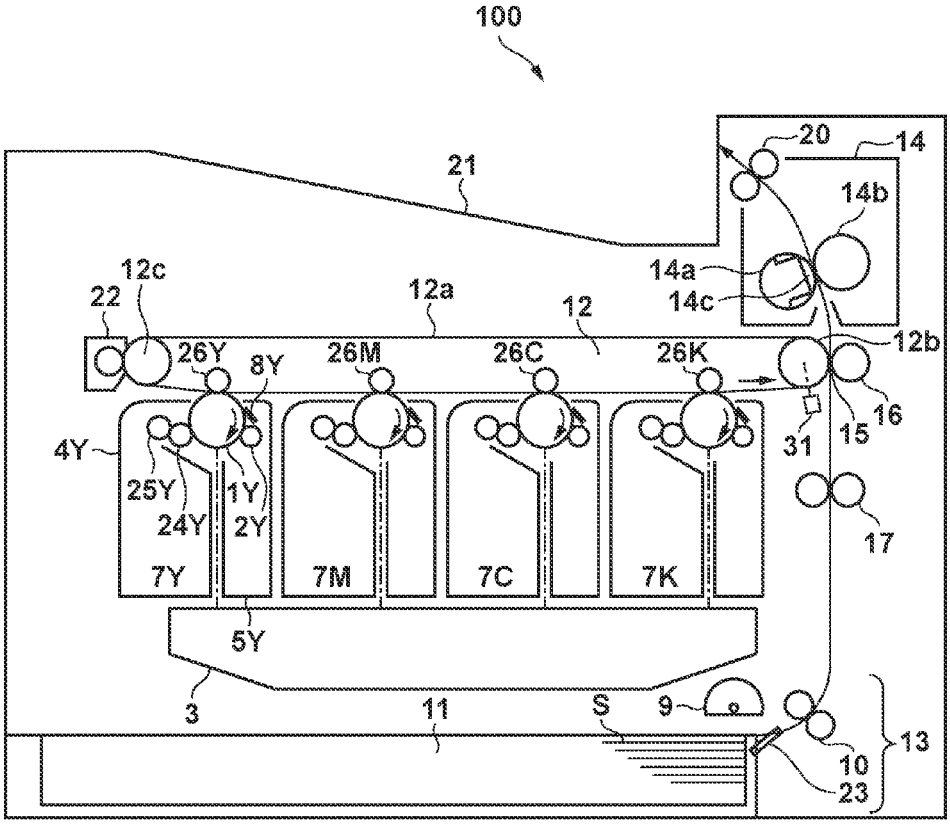
FIG. 1 is a cross-section view for illustrating an example of a hardware configuration of an image forming apparatus.

FIG. 1 is a cross-section view for illustrating an example of a hardware configuration of an image forming apparatus 100 according to a first embodiment. The image forming apparatus 100 in the present embodiment is a color laser printer for forming a multicolor image using developing material (toner) of yellow (Y), magenta (M), cyan (C), and black (K). The image forming apparatus 100 may also be any of the following: for example a print apparatus, a printer, a copying machine, a multi function peripheral (MFP), or a facsimile apparatus. Note that Y, M, C, or K on the end of reference numerals indicates that the color of the developing material (toner) of the corresponding component is yellow, magenta, cyan, or black. In the following explanation, reference numerals are used omitting the Y, M, C, or K on the end in a case where it is not necessary to distinguish the color.

The image forming apparatus 100 is equipped with 4 process cartridges 7 (process cartridges 7Y, 7M, 7C, and 7K) corresponding to image forming stations for forming images of Y, M, C, and K, respectively. In FIG. 1, reference numerals are given only for components of the process cartridge 7Y corresponding to Y, but the same configuration is employed for the four process cartridges 7Y, 7M, 7C, and 7K. However, the four process cartridges 7Y, 7M, 7C, and 7K are different in that they form images by respectively different colored (Y, M, C, and K) toner.

In a periphery of a photosensitive drum 1, a charging roller 2, an exposure unit 3, a developing unit 4, a primary transfer roller 26, and a cleaning blade 8 are arranged sequentially in a rotation direction. In the present embodiment, the photosensitive drum 1, the charging roller 2, the developing unit 4 and the cleaning blade 8 are integrated into the process cartridge 7 which can be attached/removed to/from the image forming apparatus 100. The exposure unit 3 is arranged on a lower side in a vertical direction of the process cartridge 7.

The process cartridge 7 is configured by the developing unit 4 and a cleaner unit 5. The developing unit 4 includes a developing roller 24, a developing material coating roller 25, and a toner container. Toner of the corresponding color is contained in a toner container. The developing roller 24 is rotated by a drive motor (not shown), a developing bias voltage is applied from a high voltage power supply 44 (FIG. 2), and development of an electrostatic latent image is performed using toner contained in the toner container. The cleaner unit 5 includes the photosensitive drum 1, the charging roller 2, the cleaning blade 8, and a waste toner container.

The photosensitive drum 1 is configured by an organic photo conductor layer (OPC) coated on an outer surface of an aluminum cylinder. The photosensitive drum 1 is supported to be rotatable by flanges on both ends, and is rotated in a direction of an arrow illustrated in FIG. 1 by a driving force being transferred from a drive motor (not shown) to one end. The charging roller 2 uniformly charges the surface of the photosensitive drum 1 to a predetermined electric potential. The exposure unit 3 irradiates a laser beam on the photosensitive drum 1 to expose the photosensitive drum 1 based on image information (image signal), thereby forming an electrostatic latent image on the photosensitive drum 1. The developing unit 4 forms a toner image on the photosensitive drum 1 by causing toner to attach in an electrostatic latent image on the photosensitive drum 1 and then developing the electrostatic latent image.

Figure 2:
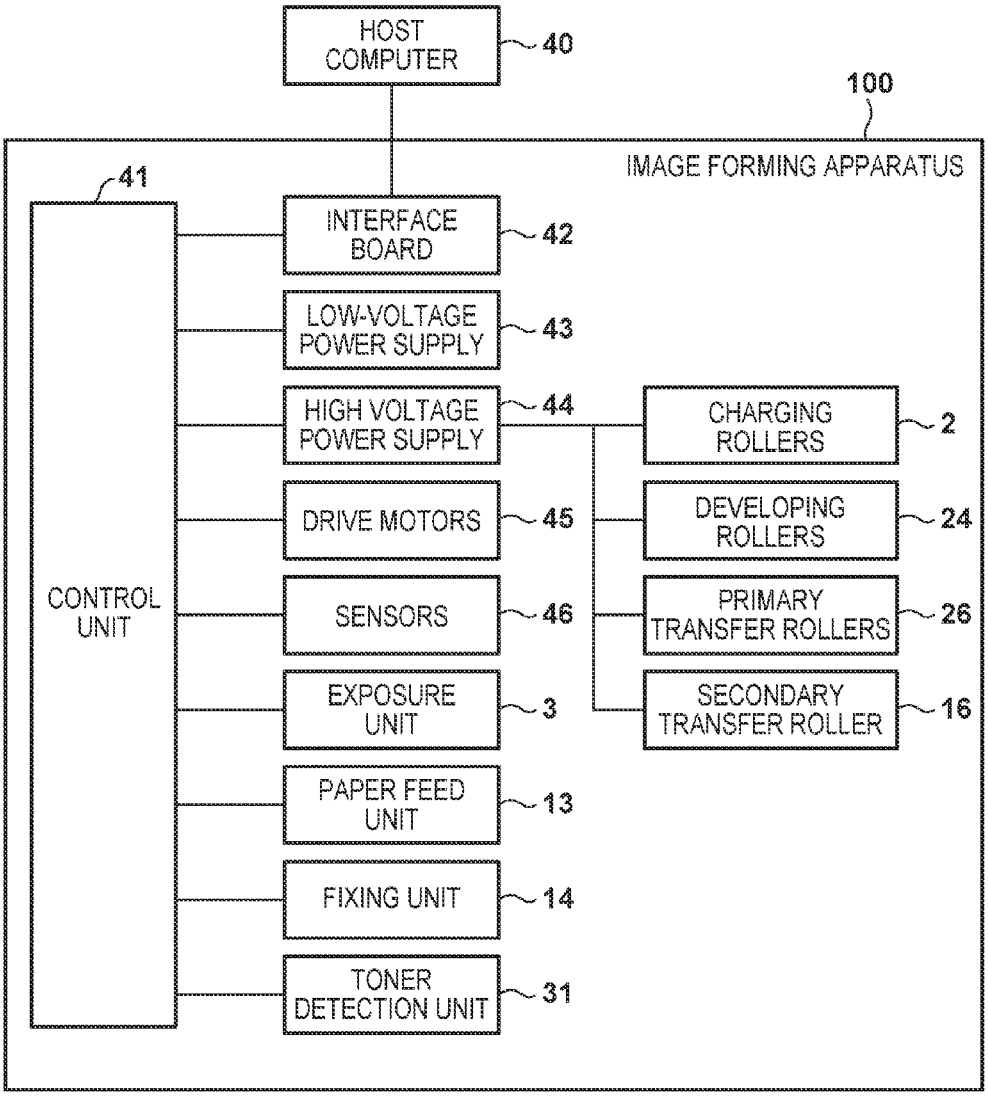
FIG. 2 is a block diagram illustrating an example configuration of a control system of the image forming apparatus.

An intermediate transfer belt 12*a*, a driving roller 12*b*, and a tension roller 12*c* configure an intermediate transfer unit 12. The intermediate transfer belt 12*a* is stretched between the driving roller 12*b* and the tension roller 12*c*, and moves (rotates) in a direction of an arrow illustrated in FIG. 1 by a rotation of the driving roller 12*b*. In the present embodiment, the intermediate transfer belt 12*a* is an example of an image carrier which is rotated. At a position inside of the intermediate transfer belt 12*a* and facing the photosensitive drum 1, the primary transfer roller 26 is arranged. The primary transfer roller 26 transfers a toner image on the photosensitive drum 1 onto the intermediate transfer belt 12*a* (an intermediate transfer member) by a transfer bias voltage applied from the high voltage power supply 44 (FIG. 2). Toner images of the four colors respectively formed on the photosensitive drums 1Y, 1M, 1C, and 1K are transferred (primary transfer) on the intermediate transfer belt 12*a* sequentially so as to overlap each other. Thus, a multicolor toner image composed of Y, M, C, and K is formed on the intermediate transfer belt 12*a*. The multicolor toner image formed on the intermediate transfer belt 12*a* is conveyed to a secondary transfer nip portion 15 between the intermediate transfer belt 12*a* and a secondary transfer roller 16 in accordance with a rotation of the intermediate transfer belt 12*a*.

A paper feed unit 13 includes a paper feed roller 9, a conveyance roller pair 10, a paper feed cassette 11, and a separation pad 23. A sheet S set by a user is contained in the feed cassette 11. The sheet S may be called recording paper, recording material, recording medium, paper, transfer material, transfer paper, or the like. The paper feed roller 9 feeds the sheet S from the feed cassette 11 to a conveyance path. Note that the sheet S contained in the feed cassette 11 is fed to the conveyance path by the separation pad 23 one sheet at a time. The conveyance roller pair 10 conveys the sheet S fed on the conveyance path toward a registration roller pair 17. When the sheet S is conveyed to the registration roller pair 17, in synchronization with a timing at which the toner image on the intermediate transfer belt 12*a* reaches the secondary transfer nip portion 15, the sheet S is conveyed to the secondary transfer nip portion 15 by the registration roller pair 17. Thus, the toner image on the intermediate transfer belt 12*a* is transferred (secondary transfer) onto the sheet S in the secondary transfer nip portion 15.

The sheet S onto which the toner image is transferred is conveyed to a fixing unit 14. The fixing unit 14 includes a fixing belt 14*a*, a pressure roller 14*b*, and a belt guide component 14*c*, and the fixing belt 14*a* is guided to a belt guide component 14*c* to which a heat generation device such as a heater is bonded. The fixing nip portion is formed between the fixing belt 14*a* and the pressure roller 14*b*. The fixing unit 14 fixes the toner image on the sheet S by applying heat and pressure to the toner image formed on the sheet S in the fixing nip portion. After the fixing process by the fixing unit 14, the sheet S is discharged to a sheet discharge tray 21 by a discharge roller pair 20.

Toner remaining on the photosensitive drum 1 after the primary transfer of the toner image to the intermediate transfer belt 12*a* is removed from the photosensitive drum 1 by the cleaning blade 8 and collected into a waste toner container in the cleaner unit 5. Also, toner remaining on the intermediate transfer belt 12*a* after the secondary transfer of the toner image to the sheet S is removed from the intermediate transfer belt 12*a* by a cleaner unit 22, and then collected in the waste toner container (not shown graphically) via a waste toner conveyance path.

A toner detection unit 31 (optical sensor) is arranged at a position facing the driving roller 12*b* in the image forming apparatus 100. The toner detection unit 31 can optically detect toner on the intermediate transfer belt 12*a* as will be described later. The image forming apparatus 100 according to the present embodiment forms a test pattern constituted by a toner image on the intermediate transfer belt 12*a*, and detects the test pattern formed on the intermediate transfer belt 12*a* by the toner detection unit 31. Additionally, the image forming apparatus 100 performs a later described calibration based on the result of the detection of the test pattern by the toner detection unit 31.

<Control Configuration of Image Forming Apparatus>

FIG. 2 is a block diagram for illustrating an example configuration of a control system of the image forming apparatus 100 according to the present embodiment. Note that in FIG. 2, only devices necessary for the explanation of the present embodiment are illustrated. The image forming apparatus 100 is equipped with a control unit 41, which incorporates a microcomputer, as an engine control unit. The image forming apparatus 100 further comprises, as devices that are connected to enable communication with the control unit 41, an interface (I/F) board 42, a low voltage power supply 43, the high voltage power supply 44, various drive motors 45, various sensors 46, the exposure unit 3, the paper feed unit 13, the fixing unit 14, and the toner detection unit 31.

The I/F board 42 is capable of communicating with a host computer 40, which is external to the image forming apparatus 100, via a network such as a LAN. The low voltage power supply 43 supplies voltage to the control unit 41 for the control unit 41 to operate. The high voltage power supply 44 supplies, in accordance with control by the control unit 41, a bias voltage to the charging rollers 2, the developing rollers 24, the primary transfer rollers 26, and the secondary transfer roller 16 at a time of image formation execution. Among the various drive motors 45 are included a drive motor for rotating the photosensitive drums 1, a drive motor for rotating the developing rollers 24, and the like. Among the various sensors 46 are included sensors other than the toner detection unit 31 such as a sensor for detecting a sheet S conveyed along the conveyance path. The control unit 41, by controlling the various devices illustrated in FIG. 2 based on various signals such as an output signal of the toner detection unit 31, output signals of the various sensors 46, or the like, executes various control such as sequence control for calibration of the image forming apparatus 100 and image formation.

<Calibration of Image Forming Apparatus>

Figure 3:
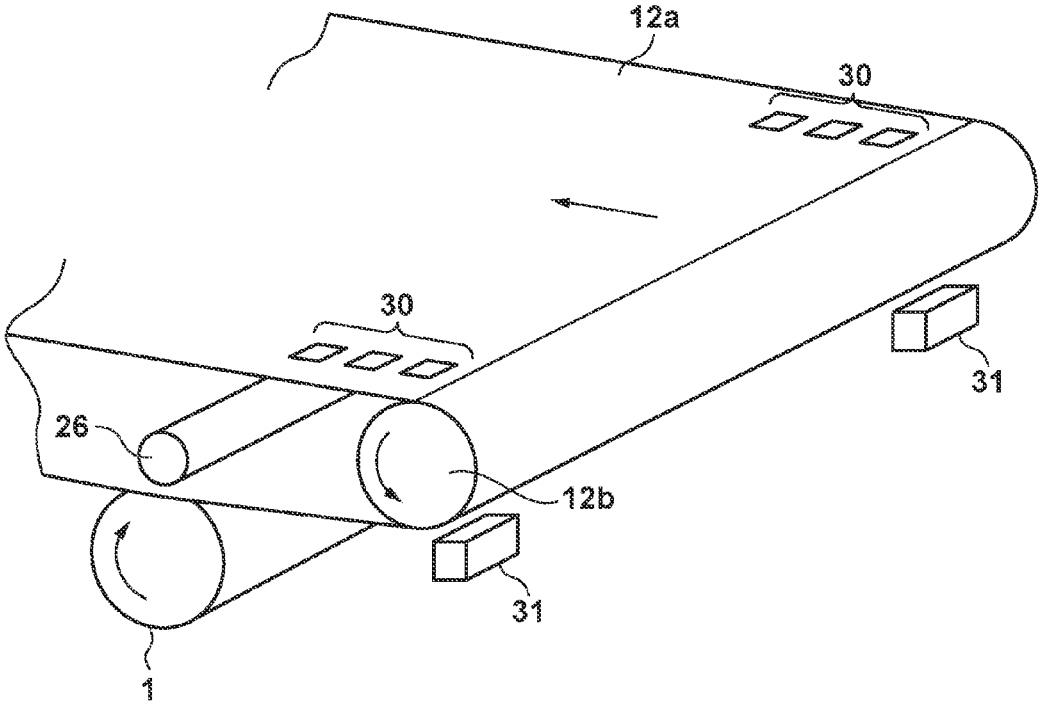
FIG. 3 is a perspective view illustrating an arrangement example of a toner detection unit in relation to an intermediate transfer belt.

Next, with reference to FIG. 3, a calibration of the image forming apparatus 100 (automatic correction control) will be described. FIG. 3 is a perspective view illustrating an arrangement example of the toner detection unit 31 in relation to the intermediate transfer belt 12*a*, and illustrates an example of a state of the intermediate transfer belt 12*a* at a time of calibration execution. Broadly divided, the calibration of the image forming apparatus 100 includes two kinds of control: "color misregistration correction control" and "image density control". These two kinds of control are both performed by forming a test pattern 30 on the intermediate transfer belt 12*a* while the image forming apparatus 100 is not performing image formation to a sheet S, and optically detecting the formed test pattern 30 by the toner detection unit 31.

If the test pattern 30 is detected by the toner detection unit 31 on a flat portion of the intermediate transfer belt 12*a*, it is difficult to obtain satisfactory sensor output due to vibration and the like at the time of belt movement. Accordingly, the toner detection unit 31 is arranged at a position facing the driving roller 12*b* via the intermediate transfer belt 12*a* as illustrated in FIG. 3 rather than at a position facing the flat portion of the intermediate transfer belt 12*a*. The test pattern 30 formed on the surface (outer surface) of the intermediate transfer belt 12*a* is detected by the toner detection unit 31 at a position facing the driving roller 12*b* when it passes the position of the driving roller 12*b*. Also, so that it is possible to detect the test pattern 30 at least two positions in a direction orthogonal to the movement direction of the surface of the intermediate transfer belt 12*a*, at least two toner detection unit 31 are arranged in such an orthogonal direction. Below, both the color misregistration correction control and the image density control will be described more specifically.

(Color Misregistration Correction Control)

The color misregistration correction control corresponds to color misregistration correction control in which an amount of relative positional misalignment (color misregistration) between the image forming stations for toner images formed by the respective image forming stations is measured, and correction of the color misregistration is performed based on the measurement results. The control unit 41 performs a color misregistration correction control by adjusting the timing at which each line is started to be written in addition to controlling the exposure units 3 so that a scanning speed and an amount of exposure light of laser beam on the photosensitive drums 1 becomes a predetermined speed and a predetermined amount of light.

For example, if the exposure unit 3 is of a polygon mirror type, the control unit 41, upon image formation, generates an image top signal by counting write start reference pulses from the exposure unit 3, and outputting the generated image top signal to the I/F board 42. The I/F board 42 outputs, in synchronization with the image top signal, exposure data one line at a time (one surface of a polygon mirror) to the exposure unit 3 via the control unit 41. By causing the output timing of the image top signal from the control unit 41 to change by an amount of time corresponding to a few dots for each image forming station, it is possible to cause the timing at which each line is started to be written to change by a few dots. With this, it is possible to adjust an image write start position in the main scanning direction of the photosensitive drum 1. Also, by causing the write timing to change in units of lines, it is possible to cause the whole image to shift in a conveyance direction (a sub scanning direction) of the toner image on the photosensitive drum 1. With this, it is possible to adjust an image write start position in the sub scanning direction of the photosensitive drum 1. Also, by controlling a difference in a rotational phase of the polygon mirror of the exposure unit 3 between the image forming stations, it is possible to perform alignment of the images of the respective colors in the sub scanning direction at a resolution of one line or less. Furthermore, it is possible to perform correction of a main-scanning magnification by causing the clock frequency to be used as the reference of ON/OFF in the exposure data to change.

In this way, correction of a color misregistration between image forming stations in the color misregistration correction control can be realized by adjusting a reference clock and an image formation timing. To realize the color misregistration correction control, it is necessary to measure the relative color misregistration amounts between the image forming stations as described above. In the color misregistration correction control, a test pattern for a color misregistration amount measurement of at least two columns on the intermediate transfer belt 12*a* is formed for each color, and positions (a time of passage of a position facing the optical sensor) of the test pattern are detected by at least two optical sensors (the toner detection unit 31). The control unit 41, based on the results of this detection, calculates a relative color misregistration amount in the main scanning direction and the sub scanning direction between the image forming stations, a magnification factor of the main scanning direction, and a relative tilt. Furthermore, the control unit 41 performs a color misregistration correction as described above so that the color misregistration amount between the image forming stations becomes small.

(Image Density Control)

Image density control is control for correcting an image forming condition so that a density characteristic of an image formed by the image forming apparatus 100 becomes a desired density characteristic. In the image forming apparatus 100, due to temperature and humidity conditions and the levels of usage of the image forming stations of the respective colors, a density characteristic of formed images (toner images) changes. Image density control is performed to correct these changes. Specifically, the test pattern 30 is formed on the intermediate transfer belt 12*a*, and based on the result of detection of the test pattern 30 by the toner detection unit 31, an image forming condition is adjusted so as to obtain a desired density characteristic. Note that the test pattern 30 may be generated by the control unit 41, or may be generated by an external apparatus (for example, the host computer 40).

The control unit 41 (CPU) calculates (detects a density of a toner image) a value corresponding to a density of the toner image which is the test pattern 30 from a received light amount signal after A/D (analog/digital) conversion which is outputted from the toner detection unit 31. Furthermore, the control unit 41, based on the result of the detection of the density of the toner image, sets the image forming condition to be used when performing image formation. The image forming condition that is set is a charge bias voltage, a developing bias voltage, an amount of exposure light (the laser power of the exposure unit 3), or the like, for example. By repeating such settings, it is possible to optimize an image forming condition related to an image density characteristic. Note that the control unit 41 stores in a memory within the control unit 41 the image forming condition that has been set, so as to be able to use it at a time of image formation and at a time of the next image density control.

By performing such image density control, it is possible to adjust the maximum density of each color to a desired value, and it is possible to prevent the occurrence of an image defect called "fogging" in which unwanted toner adheres to a white background portion of an image. Also, by performing the image density control, it is possible to keep fixed the color balance of the respective colors, and to prevent an image defect and a fixing defect due to excessive application of toner.

<Configuration of Toner Detection Unit>

Figure 4:
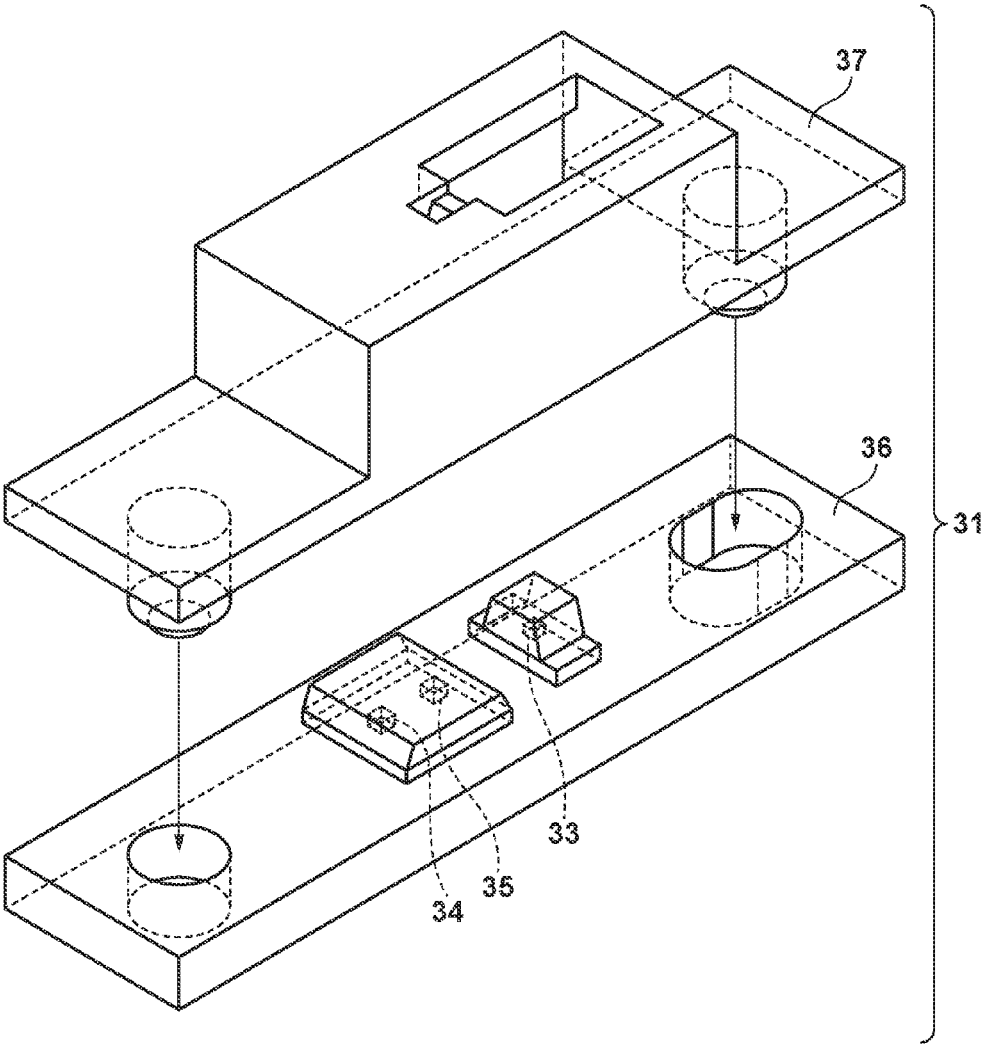
FIG. 4 is a perspective view illustrating an example configuration of the toner detection unit.
Figure 5A:
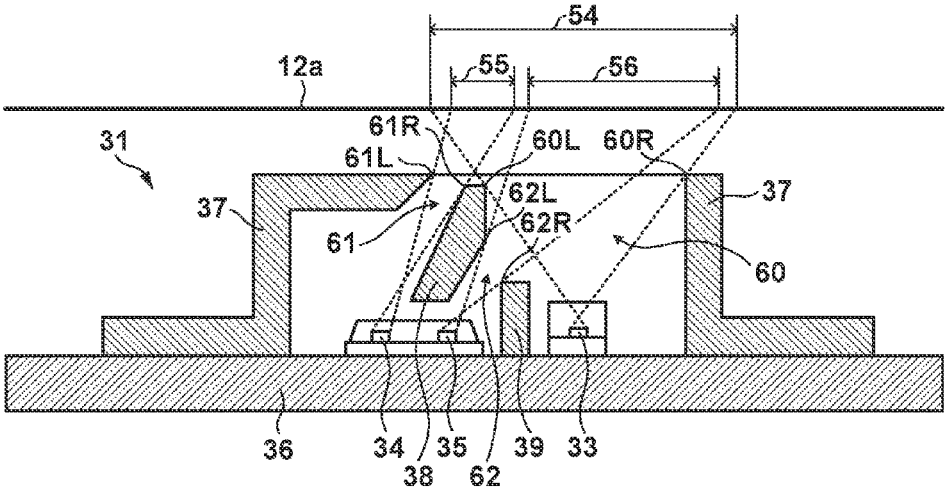
FIGS. 5A to 5C are cross-sectional views for illustrating an example configuration of the toner detection unit.
Figure 5B:
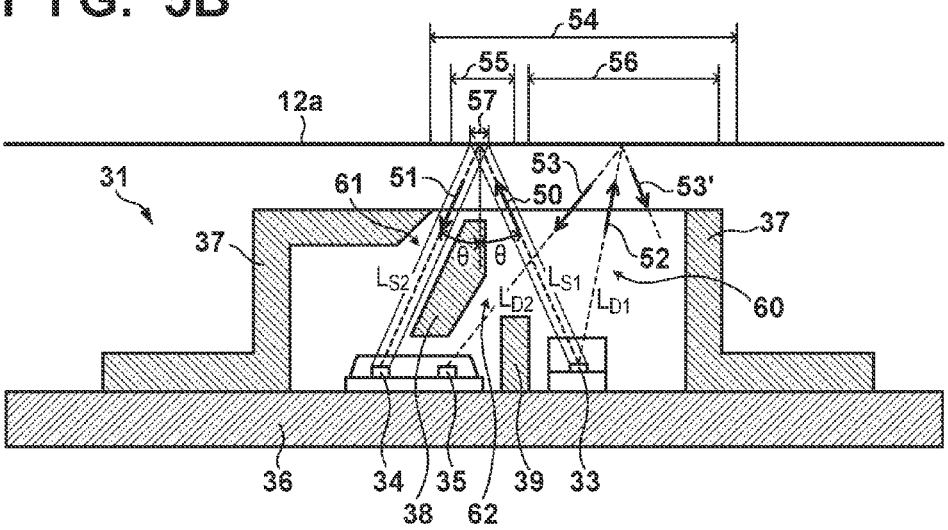
Figure 5C:
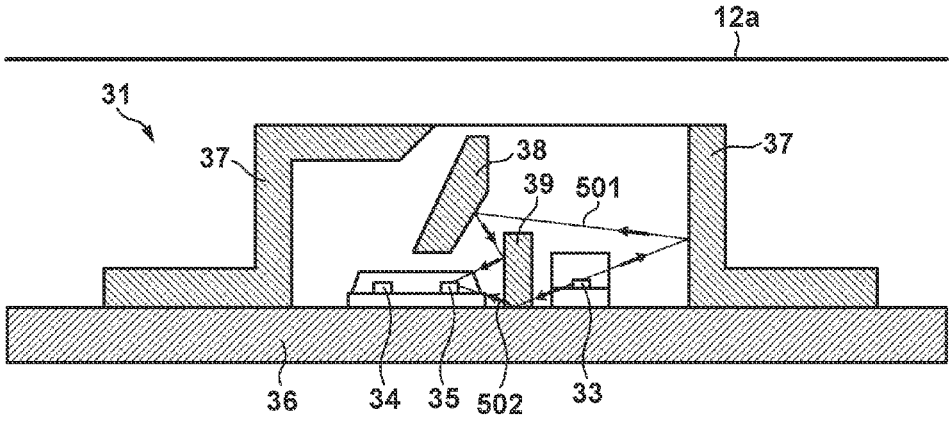

Next, a configuration of the toner detection unit 31 which is for detecting the test pattern 30 is described. FIG. 4 and FIGS. 5A to 5C are respectively a perspective view and an outline cross-sectional view illustrating an example configuration of the toner detection unit 31. The toner detection unit 31, as illustrated in FIG. 4, has a configuration in which a housing 37 is fixed to a circuit board 36 by projecting portions of the housing 37 being inserted into holes arranged in the circuit board 36. FIGS. 5A to 5C illustrate states in which the housing 37 is fixed in relation to the circuit board 36.

The toner detection unit 31 comprises an LED 33 (a light emitting element) and two light receiving elements 34 and 35 as optical elements. The LED 33 irradiates light towards the intermediate transfer belt 12*a* which is an irradiated member. That is, the LED 33 irradiates light towards the intermediate transfer belt 12*a* after the toner, which is the detection target (measurement target object), has been attached. The light receiving elements 34 and 35 are used to respectively receive the specular reflection light and the diffused reflection light of the light that the LED 33 irradiated toward the intermediate transfer belt 12*a*. In the toner detection unit 31, the housing 37 is configured to respectively guide, to the light receiving elements 34 and 35, the specular reflection light and the diffused reflection light of the light that the LED 33 irradiated to the intermediate transfer belt 12*a*.

The LED 33 and the two light receiving elements 34 and 35 are directly mounted on the surface (mounting surface) of the same circuit board 36, and are mounted in a line on the circuit board 36. The light receiving elements 34 and 35, which respectively receive the specular reflection light and the diffused reflection light of light that the LED 33 irradiates toward the intermediate transfer belt 12*a*, are arranged beside each other on the circuit board 36. In the present embodiment, the light receiving element 34 is arranged at a position more separated from the LED 33 than the light receiving element 35, and the light receiving element 35 is arranged at a position closer to the LED 33 than the light receiving element 34. Also, as illustrated in FIGS. 5A to 5C, a light shielding wall 39 to prevent light emitted from the LED 33 from being received directly by the light receiving element 35 is provided between the LED 33 and the light receiving element 35.

The light receiving elements 34 and 35 of the present embodiment is configured by an integrated circuit (IC) in which phototransistors (semiconductors) having a sensitivity to wavelengths of light emitted from the LED 33 are integrated and COB-mounted on a substrate. The phototransistors mounted on the substrate are covered by a transmissive resin material. The LED 33 (light emitting element) and the light receiving elements 34 and 35 of the present embodiment use infrared light. The substrate on which the light receiving elements 34 and 35 are mounted is arranged on the circuit board 36. However, a light emitting element and light receiving elements that use light of other wavelengths may be used in the toner detection unit 31 if the light is of a wavelength to which the light receiving elements are sensitive depending on the combination of the light emitting element and the light receiving elements. Also, in place of phototransistors, photodiodes may be used as the light receiving elements 34 and 35.

As illustrated in FIG. 5A, a light guiding path 60 is provided in the housing 37 of the toner detection unit 31 to guide light emitted from the LED 33 toward the intermediate transfer belt 12*a*. Light guiding paths 61 and 62 are further provided in the housing 37 to guide reflected light of the light emitted from the LED 33 to the light receiving elements 34 and 35. The light guiding paths 60 and 61 are configured by openings arranged in the housing 37, and are separated by a light shielding wall 38. Also, the light guiding path 62 is configured by the light shielding wall 38 and the light shielding wall 39, and is separated from the light guiding path 61 by the light shielding wall 38. Note that, within the housing 37, the light guiding path 62 overlaps a portion of the light guiding path 60 which guides light emitted from the LED 33 towards the intermediate transfer belt 12*a*, which is the irradiated member, and this contributes to the miniaturization of the toner detection unit 31.

The light shielding wall 38 is arranged so that the diffused reflection light from a light-receivable region 55 which is described later is not received by the light receiving element 35 (so that the diffused reflection light is not incident on the light receiving element 35 through the light guiding path 62). The light shielding wall 38 is formed integrally in the housing 37, is arranged above, in a vertical direction in relation the mounting surface of the circuit board 36, the position of the light receiving element 35 on the mounting surface (that is, immediately above the light receiving element 35), and is formed close to the opening of the housing 37.

(Irradiation Region 54 of Light from the LED 33)

Here, the irradiation region 54 of the light from the LED 33 as illustrated in FIG. 5A corresponds to a region in which light from the LED 33 is irradiated on the outer surface of the intermediate transfer belt 12*a* (on the image carrier). The irradiation region 54 is defined by a straight line connecting a left corner 60L of the light guiding path 60 and one edge of the LED 33, and a straight line connecting a right corner 60R of the light guiding path 60 and the other edge of the LED 33.

(Light-Receivable Regions 55 and 56 for the Light Receiving Elements 34 and 35)

The light-receivable region 55 for the light receiving element 34 illustrated in FIG. 5A corresponds to a region (range), within the irradiation region 54, in which light that the light receiving element 34 can receive is irradiated by the LED 33, and is a region that is a portion of the irradiation region 54. The light-receivable region 55 is defined by a straight line connecting a left corner 61L of the light guiding path 61 and one edge of the light receiving element 34 and a straight line connecting a right corner 61R of the light guiding path 61 and the other edge of the light receiving element 34.

The light-receivable region 56 of the light receiving element 35 illustrated in FIG. 5A corresponds to a region (range), within the irradiation region 54, in which light that the light receiving element 35 can receive is irradiated by the LED 33, and is a region that is a portion of the irradiation region 54. The light-receivable region 56 is defined by a straight line connecting a left corner 62L of the light guiding path 62 and one edge of the light receiving element 35 and a straight line connecting a right corner 62R of the light guiding path 62 and the other edge of the light receiving element 35.

In the present embodiment, as illustrated in FIG. 5A, the housing 37 is configured to guide the specular reflection light from the light-receivable region 55 within the irradiation region 54 of the LED 33 to the light receiving element 34, and to guide the diffused reflection light from the light-receivable region 56 within the irradiation region 54 to the light receiving element 35. Also, the housing 37 is configured so that the light-receivable region 55 and the light-receivable region 56 are mutually different regions. Note that the light-receivable region 55 and the light-receivable region 56 are not regions that overlap each other in the present embodiment, but they may partially (for example, edges of each region) overlap.

In the toner detection unit 31, the specular reflection light that the light receiving element 34 receives among the light emitted from the LED 33, as illustrated in FIG. 5B, is light that travels in a direction along an optical axis line 50 in the light guiding path 60, and that is irradiated on the outer surface of the intermediate transfer belt 12*a*. The specular reflection light from the outer surface of the intermediate transfer belt 12*a* travels in a direction along an optical axis line 51 approximately, is guided within the light guiding path 61 of the housing 37, reaches the light receiving element 34 and is received. More specifically, the light receiving element 34 receives, among the light irradiated from the LED 33, light (specular reflection light) that is incident at an incident angle θ in a region 57 within the light-receivable region 55 and that is reflected at a reflection angle θ, as well as diffused reflection light of the light that is incident on the light-receivable region 55.

Meanwhile, if the test pattern 30, which is a toner image, is present in the irradiation region 54 on the outer surface of the intermediate transfer belt 12*a*, light emitted from the LED 33 is specularly reflected by the outer surface of the intermediate transfer belt 12*a* and is diffusely reflected by the test pattern 30. A portion of such reflected light is reflected in a direction along the optical axis line 51, reaches the light receiving element 34 and is received, and another portion is reflected in a direction along an optical axis line 53, passes through the light guiding path 62, reaches the light receiving element 35 and is received.

Figure 6:
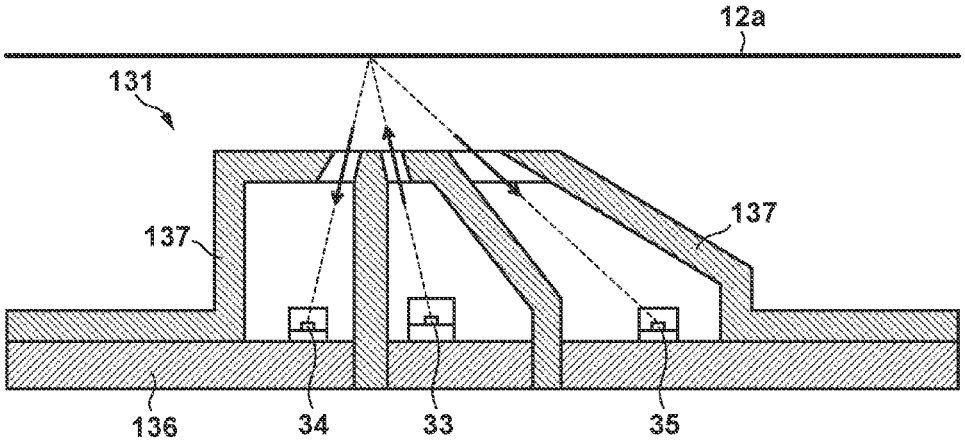
FIG. 6 is a perspective view illustrating an example configuration of a toner detection unit which is a comparative example.

In the present embodiment, as illustrated in FIG. 4 and FIGS. 5A to 5C, by mounting the two light receiving elements 34 and 35 as an IC on the circuit board 36, miniaturization of the toner detection unit 31 over what was conventional is realized. Here, in FIG. 6, a cross-sectional view illustrating a configuration of the toner detection unit 131 is illustrated as a comparative example in contrast to the present embodiment. In the toner detection unit 131 illustrated in FIG. 6, two light receiving elements 34 and 35 that respectively receive the specular reflection light and the diffused reflection light of light emitted from the LED 33 (light emitting element) are mounted on a circuit board 136 as independent circuit elements. Also, in conformity with this kind of mounting, separate openings corresponding to the LED 33 and the two light receiving elements 34 and 35 are provided on a housing 137. In the toner detection unit 31 of the present embodiment, it is possible to miniaturize a size of a direction (horizontal direction in FIG. 6) in which the LED 33 and the two light receiving elements 34 and 35 are arranged over the toner detection unit 131 illustrated as the comparative example.

Also, when using the toner detection unit 31 of the present embodiment, it is possible to detect toner images (the test pattern 30) simultaneously in two different regions (light-receivable regions 55 and 56) on the intermediate transfer belt 12*a*. For example, the toner detection unit 31 is arranged so that the two light receiving elements 34 and 35 are arranged in a direction orthogonal to a movement direction of the surface of the intermediate transfer belt 12*a*. In such a case, the light-receivable regions 55 and 56 for the light receiving elements 34 and 35 are arranged in a direction orthogonal to the movement direction of the surface of the intermediate transfer belt 12*a*. As a result, when the toner detection unit 31 is used, it is possible to detect the toner images (the test pattern 30) which respectively passes through the light-receivable region 55 and the light-receivable region 56 at a timing when the rotational phases of the intermediate transfer belt 12*a* are the same phase.

The toner detection unit 31 of the present embodiment, as illustrated in FIGS. 5A to 5C, is configured so that the light-receivable region 56 for the light receiving element 35 that receives diffused reflection light is wider than the light-receivable region 55 for the light receiving element 34 that receives the specular reflection light. The specular reflection light of the light emitted from the LED 33 is strong light having a comparatively high directivity. In contrast to this, the diffused reflection light of the light emitted from the LED 33 is scattered in various directions and is weak light that has a low directitivity. Accordingly, in the present embodiment, the light-receivable region 56 for receiving the diffused reflection light is made to be wider than the light-receivable region 55 for receiving the specular reflection light so that the received light amount of the diffused reflection light by the light receiving element 35 becomes greater. That is, as illustrated in FIGS. 5A to 5C, the size of the light-receivable region 56 is larger than that of the light-receivable region 55 in the direction in which the light receiving element 34 and the light receiving element 35 are arranged. Note that in the present embodiment, the two light receiving elements 34 and 35 are integrated to miniaturize the toner detection unit 31, but they may be arranged as independent circuit elements in proximity at positions similar to in the present embodiment. In such cases, it is also possible to realize a miniaturized toner detection unit 31 similar to the present embodiment.

<Optical Detection Unit>

Figure 7:
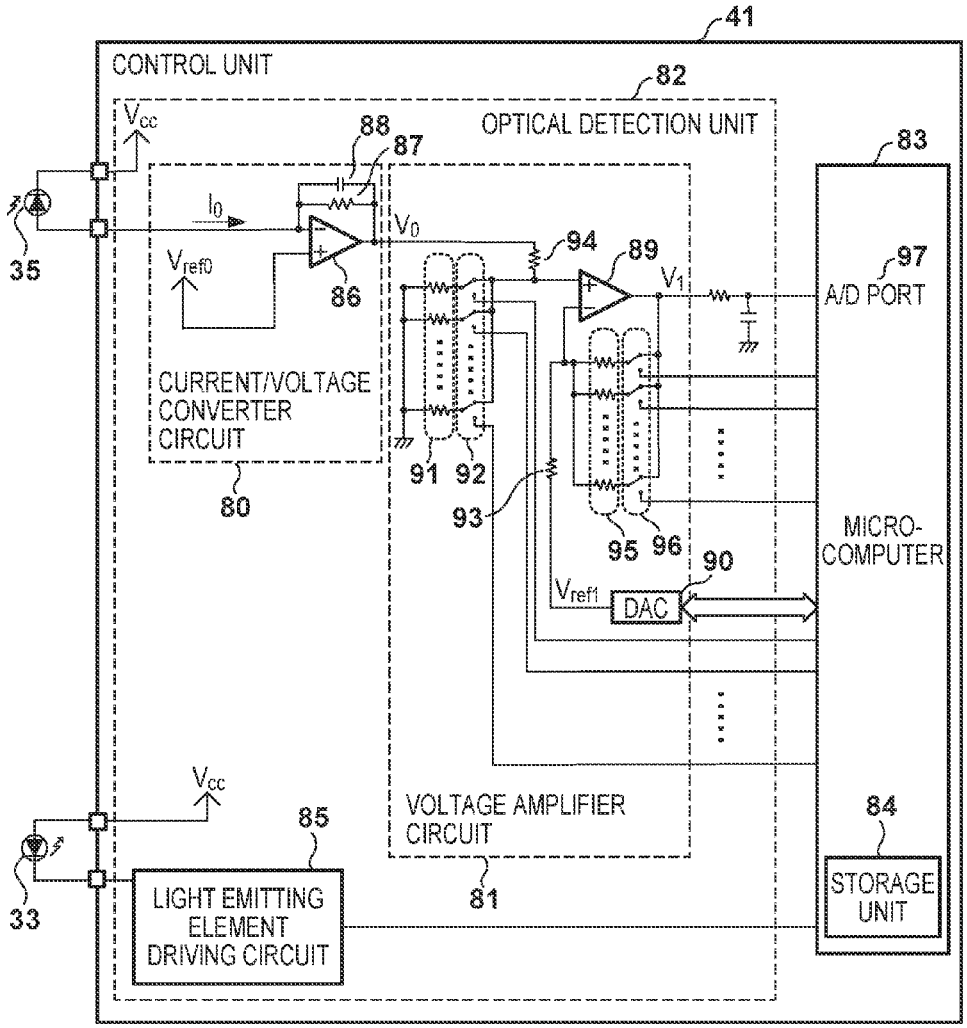
FIG. 7 is a circuit diagram illustrating an example configuration of a control unit.

Next, with reference to FIG. 7, an optical detection unit 82 connected with the LED 33 and the light receiving element 35 of the toner detection unit 31 is described. FIG. 7 is a circuit diagram illustrating an example configuration of the optical detection unit 82 according to the present embodiment which is arranged in the control unit 41 (DC controller). In the control unit 41, the optical detection unit 82 and a microcomputer 83 are arranged.

In the present embodiment, the light receiving elements 34 and 35 respectively output, as detection signals, current of values corresponding to received light amounts. The optical detection unit 82 converts current output from the light receiving elements 34 and 35 into voltage, and amplifies the voltage after the conversion, and outputs it to the microcomputer 83. The microcomputer 83, based on the voltage outputted from the optical detection unit 82, detects a density or a position of an image (toner image) formed as the test pattern 30 on the intermediate transfer belt 12*a*. The microcomputer 83 executes the foregoing color misregistration correction control based on to the detected position of the image, or executes the foregoing image density control based on the detected density of the image. Note that, in FIG. 7, only configurations corresponding to the light receiving element 35 are illustrated, and configurations corresponding to the light receiving element 34 are omitted.

As illustrated in FIG. 7, the optical detection unit 82 is configured by a light emitting element driving circuit 85, a current/voltage converter circuit 80, and a voltage amplifier circuit 81. The light emitting element driving circuit 85 is a circuit that, in accordance with a control signal from the microcomputer 83, supplies a driving current to the LED 33, which is a light emitting element, to drive the LED 33. The microcomputer 83 controls the light emitting element driving circuit 85 so that a defined current flows through the LED 33. With this, the LED 33 (the light emitting element) irradiates light towards the intermediate transfer belt 12*a*. Meanwhile, the light receiving element 35 outputs current in accordance with the received light amount.

The current/voltage converter circuit 80 is a circuit that converts a current $I_0$ that is in accordance with the received light amount of the light receiving element 35 and that is outputted from the light receiving element 35, into a voltage $V_0$ and outputs the converted voltage. The voltage amplifier circuit 81 is a circuit that amplifies a difference between the voltage $V_0$ outputted from the current/voltage converter circuit 80 and a reference voltage $V_{ref1}$, and outputs the amplified difference as a voltage $V_1$ corresponding to the received light amount of the light receiving element 35. The voltage $V_1$ outputted from the voltage amplifier circuit 81 is inputted into the microcomputer 83 via an A/D port 97. Below, the configurations of the current/voltage converter circuit 80 and the voltage amplifier circuit 81 will be described in detail.

The current/voltage converter circuit 80 is a circuit that is configured by an operational amplifier 86, a capacitor 88 and a resistor 87, and that converts the current $I_0$ which flows through the light receiving element 35 (which is outputted from the light receiving element 35) into the voltage $V_0$. A reference voltage for current/voltage conversion (IV conversion) $V_{ref0}$ (hereinafter referred to as an "IV conversion reference voltage".) is inputted to a positive side terminal of the operational amplifier 86. A negative side terminal of the operational amplifier 86 is in a virtual short-circuit relationship with the positive side terminal, and thus the voltage of the negative side terminal of the operational amplifier 86 is $V_{ref0}$. As a result, an output voltage $V_0$ of the operational amplifier 86 becomes a value obtained by a voltage drop occurring in the IV conversion reference voltage $V_{ref0}$ in accordance with the current that flows through the resistor 87.

Specifically, let the value of the current that flows through the light receiving element 35 be $I_0$, the resistance value of the resistor 87 be $R_0$, and the reference voltage of the operational amplifier 86 (the IV conversion reference voltage) be $V_{ref0}$; then the output voltage $V_0$ of the operational amplifier 86 can be obtained by the following formula.

$$V_0=V_{ref0}-R_0\times I_0 \quad (1)$$

The output voltage $V_0$ of the operational amplifier 86 is inputted into the voltage amplifier circuit 81 as the output voltage of the current/voltage converter circuit 80.

The voltage amplifier circuit 81 is a differential amplifier circuit that is configured by an operational amplifier 89, resistors 93 and 94, resistor arrays 91 and 95, switch arrays 92 and 96, and a D/A converter (DAC) 90, and that amplifies a difference between the output voltage of the current/voltage converter circuit 80 (the output voltage of the operational amplifier 86) $V_0$ and the reference voltage $V_{ref1}$. In the present embodiment, as will be described below, the reference voltage $V_{ref1}$ and an amplification factor (voltage amplification factor) Av of the voltage amplifier circuit 81 (the operational amplifier 89) are controlled by the microcomputer 83.

The reference voltage $V_{ref1}$ used by the operational amplifier 89 of the voltage amplifier circuit 81 is outputted from the D/A 90. The microcomputer 83 performs communication with the DAC 90, and causes the voltage $V_{ref1}$ used as the reference voltage of the operational amplifier 89 to be outputted from the DAC 90. The microcomputer 83 controls (adjusts) the reference voltage $V_{ref1}$ by controlling the DAC 90. Also, the microcomputer 83 controls (adjusts) the amplification factor Av of the voltage amplifier circuit 81 (the operational amplifier 89) by controlling a resistance value $R_4$ of a resistor array 91 and a resistance value $R_2$ of the resistor array 95.

The resistor arrays 91 and 95 are configured by a plurality of resistors connected in parallel. Each of the resistance values $R_4$ and $R_2$ of the respective resistor arrays 91 and 95 corresponds to a combined resistance value of resistors connected in parallel, and changes in accordance with the number of resistors connected in parallel. The resistor array 91 is connected with the switch array 92, and each resistor of the resistor array 91 is connected with a corresponding switch included in the switch array 92. Also, the resistor array 95 is connected with the switch array 96, and each resistor of the resistor array 95 is connected with a corresponding switch included in the switch array 96. The microcomputer 83 controls the connection/non-connection of the respective resistors included in the resistor arrays 91 and 95 by controlling ON/OFF of respective switches included in the switch arrays 92 and 96, and thereby controls the resistance values of the resistor arrays 91 and 95 (combined resistance values). In the present embodiment, as an example, 20 resistors are arranged in parallel in each of the resistor arrays 91 and 95, and the resistance value of each resistor is 200 [kΩ].

Let the resistance values of the resistor 93, the resistor array 95, the resistor 94, and the resistor array 91 be $R_1$, $R_2$, $R_3$, and $R_4$ respectively, where $R_2=R_4$ and $R_1=R_3$; then the output voltage $V_1$ and the voltage amplification factor Av of the voltage amplifier circuit 81 (the operational amplifier 89) are obtained by the following formula.

$$V_1=(V_0-V_{ref1})\times R_2/R_1 \quad (2)$$

$$Av=R_2/R_1 \quad (3)$$

Using Equation (1) and (2), it is possible to express the output voltage $V_1$ of the operational amplifier 89 by the following formula.

$$V_1=(V_{ref0}-R_0\times I_0-V_{ref1})\times R_2/R_1 \quad (4)$$

The output voltage $V_1$ of the operational amplifier 89 is inputted to the A/D port 97 of the microcomputer 83 as the output voltage of the voltage amplifier circuit (the optical detection unit 82).

In the present embodiment, the microcomputer 83, based on the output voltage $V_1$ of the voltage amplifier circuit 81, controls (adjusts) each of parameters (the reference voltage $V_{ref1}$, the (combined) resistance value $R_4$ of the resistor array 91, and the (combined) resistance value $R_2$ of the resistor array 95) that are used in the voltage amplifier circuit 81. The microcomputer 83, as will be described later, adjusts such parameters of the voltage amplifier circuit 81 so that the range of the voltage $V_1$ to be inputted into the microcomputer 83 is made to be a range suitable for detection of the position (color misregistration amount) and density of the toner image using the toner detection unit 31.

<Reflected Light (Unwanted Reflected Light) within Housing>

As described above, the toner detection unit 31 of the present embodiment has a configuration in which the LED 33 and the light receiving element 35 which receives diffused reflection light of the light emitted from the LED 33 are arranged close together for the objective of miniaturization. The housing 37 of the toner detection unit 31 is configured to guide the light emitted from the LED 33 toward the intermediate transfer belt 12*a*, and to guide the diffused reflection light from the intermediate transfer belt 12*a* to the light receiving element 35. A common opening through which light emitted from the LED 33 and light to be incident on the light receiving element 35 can pass is formed in the housing 37. That is, the housing 37 is configured so that an outlet for light irradiated toward the intermediate transfer belt 12*a* from the LED 33, and an inlet for diffused reflection light of the light emitted from the LED 33 are common.

In the toner detection unit 31 which is configured in this way, there is a problem in that since a portion of the light emitted from the LED 33 is irradiated onto the light receiving element 35 as reflected light (hereinafter referred to as "unwanted reflected light".) within the housing 37 due to propagation along a light path such as the light paths 501 or 502 as illustrated in FIG. 5C. Specifically, a portion of the light emitted from the LED 33 is irradiated onto the light receiving element 35 by being reflected within the housing 37 and propagating along the light path 501, rather than being emitted to the exterior of the housing 37 from the opening. Also, the toner detection unit 31, as described above, includes the light shielding wall 39 which is for preventing light emitted from the LED 33 from being received directly by the light receiving element 35. However, due to variation in the shape of the component used as the light shielding wall 39, a portion of the light emitted from the LED 33 is irradiated onto the light receiving element 35 by propagating along the light path 502 when a small space occurs between the circuit board 36 and the light shielding wall 39.

When light that propagates along the light paths 501 and 502 is irradiated onto the light receiving element 35, the light receiving element 35 receives the foregoing unwanted reflected light not only the diffused reflection light from the toner image or the surface of the intermediate transfer belt 12*a*. As a result, the output voltage of the voltage amplifier circuit 81 (input voltage of the microcomputer 83) $V_1$ becomes a voltage corresponding to a current in which a current in accordance with the received light amount of the unwanted reflected light is overlapped on a current in accordance with the received light amount of the diffused reflection light from the toner image or the surface of the intermediate transfer belt 12*a*.

Figure 8A:
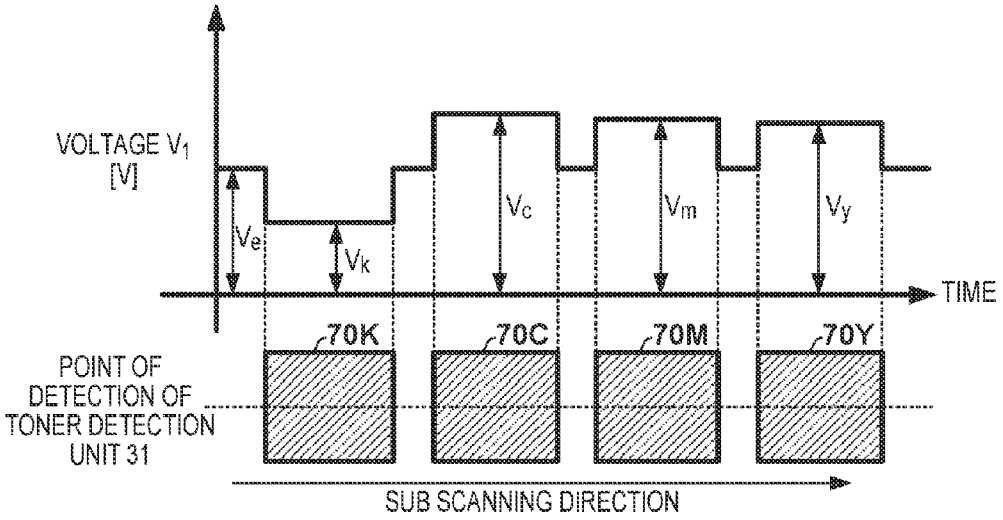
FIGS. 8A and 8B illustrate examples of output voltage waveforms of a voltage amplifier circuit.
Figure 8B:
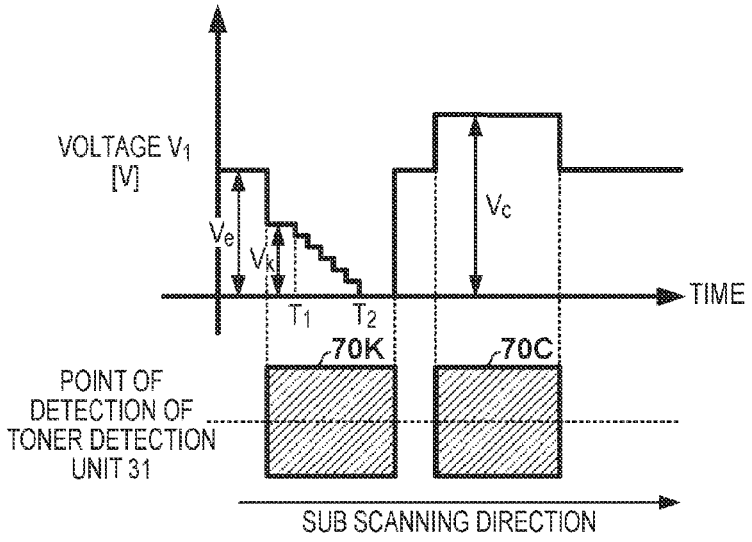

Here, FIG. 8A illustrates an example of waveforms of output voltages (input voltages of the microcomputer 83) of the voltage amplifier circuit 81 in a case where the test pattern 30 is formed on the intermediate transfer belt 12*a*, and the test pattern 30 is detected by the toner detection unit 31. Note that the output voltage $V_1$ of the voltage amplifier circuit 81 in a case where the light receiving element 35 receives a diffused reflection light from the surface of the intermediate transfer belt 12*a* or the toner image is illustrated in FIG. 8A and FIG. 8B. Here, a plurality of patch images 70K, 70C, 70M, and 70Y, which are toner images of K, C, M, and Y respectively, are formed in order on the intermediate transfer belt 12*a* as the test pattern 30, and each patch image is detected in order by the toner detection unit 31 (the light receiving element 35). The patch images 70K, 70C, 70M, and 70Y are formed in one line in the sub-scanning direction on the intermediate transfer belt 12, and are arranged at a point of detection by the toner detection unit 31 while being conveyed by the intermediate transfer belt 12*a*. This point of detection is a point at which each patch image conveyed by the intermediate transfer belt 12 passes through the light-receivable region 56 (particular region) of the light receiving element 35.

FIG. 8A illustrates a temporal change of the output voltage (the input voltage of the microcomputer 83) $V_1$ of the voltage amplifier circuit 81 in a case where the patch images 70K, 70C, 70M, and 70Y which are formed as described above are detected by the toner detection unit 31. In this figure, $V_e$ is the input voltage $V_1$ in a case where the light receiving element 35 receives reflected light (reflected light from the surface of the intermediate transfer belt 12*a*) from a region in which a patch image (toner image) is not formed on the intermediate transfer belt 12*a*. Also, $V_k$, $V_c$, $V_m$, and $V_y$ are respectively the input voltage $V_1$ in cases where the light receiving element 35 receives reflected light from patch images of K, C, M, and Y.

Here, the resistance values $R_0$, $R_1$, and $R_3$ of the resistors 87, 93 and 94, the IV conversion reference voltage $V_{ref0}$, and the reference voltage $V_{ref1}$ of the voltage amplifier circuit 81, are set to $R_0$=2 [MΩ], $R_1$=$R_3$=10 [kΩ], $V_{ref0}$=2.0 [V], and $V_{ref1}$=0.6 [V]. In addition, in the resistor arrays 95 and 91, by putting all of the 20 resistors each having 200 [kΩ] in a connected state, the resistance values $R_2$ and $R_4$ of the resistor arrays 95 and 91 are set to $R_2$=$R_4$=10 [kΩ].

Note that, as described above, the output voltage $V_0$ of the operational amplifier 86, becomes a value obtained by a voltage drop occurring in the input voltage of the positive side terminal of the operational amplifier 86 (the IV conversion reference voltage $V_{ref0}$) in accordance with the current $I_0$ that flows through the resistor 87. Accordingly, the IV conversion reference voltage $V_{ref0}$ is set so that $V_0$ does not becomes 0[V] even if the current $I_0$ of the maximum value that is envisioned (upper limit value) flows. Also, the reference voltage $V_{ref1}$, as indicated in Equation (2), is set so that the output voltage $V_1$ of the operational amplifier 89 becomes 0 [V] or greater in a case where $V_0$ is a lower limit value (it is made to be 1.2 [V] in the present example.).

In FIG. 8A, the microcomputer 83 controls the light emitting element driving circuit 85 to cause the LED 33 to emit a predetermined amount of light, and causes the current $I_0$ outputted from the LED 33 when the K and C patch images respectively pass through the light-receivable region 56 to be 400 and 100 [nA]. In this case, the input voltages of the microcomputer 83 are $V_k$=0.6 [V] and $V_c$=1.2 [V]. Typically, the K patch image absorbs light and has a very low reflectance, and thus the amount of diffused reflection light from the K patch image is small. Accordingly, when the patch image 70K for K passes through the light-receivable region 56, hardly any current is output from the light receiving element 35. As a result, $V_k$ becomes lower than $V_c$, $V_m$, and $V_y$, and ideally $V_k$=0 [V].

However, in FIG. 8A, even in a case where light from the LED 33 is irradiated onto the patch image 70K for K, 0.6 [V] is generated as $V_k$ due to the light receiving element 35 receiving unwanted reflected light that mainly propagates through the light paths 501 and 502 of FIG. 5C. The voltage of this 0.6 [V] is voltage that corresponds to the received light amount of the unwanted reflected light. Additionally, even for the voltage $V_c$ in the case where the light from the LED 33 is irradiated onto the patch image for C, 0.6 [V], which is the voltage corresponding to the received light amount of the unwanted reflected light, is overlapped thereon. That is, the voltage 0.6 [V] corresponding to the received light amount of unwanted reflected light is added to the voltage 0.6 [V] corresponding to the received light amount of the diffused reflection light from the intermediate transfer belt 12*a*, and this results in $V_c$=1.2 [V]. Note that it is similar for the input voltages $V_m$ and $V_y$ of the microcomputer 83 for M and Y patch images. The voltage (0.6 [V]) corresponding to the received light amount of such unwanted reflected light has an influence on the detection precision for the position or density of the patch image because a dynamic range of signal amplitude is decreased.

If the density of the patch image is detected based on the voltage (voltage $V_1$) corresponding to the received light amount of the light receiving element 35, for example, the relative difference of $V_k$, $V_c$, $V_m$, and $V_y$ is converted to a density of the image on the intermediate transfer belt 12*a*. Accordingly, an error occurs in the detection result of the density of the image due to the voltage corresponding to the received light amount of unwanted reflected light.

Also, if detecting the density of an image, the dynamic range of the voltage for detection is widened by amplifying the voltage converted from the current in accordance with the received light amount of the light receiving element 35 in order to reduce the influence of voltage fluctuation due to an unevenness of the intermediate transfer belt 12*a* or due to an electrical noise component. However, when the light receiving element 35 receives unwanted reflected light that mainly propagates through the light paths 501 and 502 of FIG. 5C, the voltage (0.6 [V]) that corresponds to the received light amount of unwanted reflected light is amplified by the amplifier circuit (the voltage amplifier circuit 81). As a result, it becomes impossible to ensure a sufficient dynamic range in the voltage for detection of density of the image, and it becomes impossible to sufficiently improve the detection precision for the density.

Accordingly, in the present embodiment, in order to reduce the influence that unwanted reflected light mainly propagating through the light paths 501 and 502 of FIG. 5C has on the light reception result of the light receiving element 35, the reference voltage $V_{ref1}$ used in the voltage amplifier circuit 81 is adjusted. Specifically, the microcomputer 83 causes the LED 33 (the light emitting element) to emit light and executes a measurement of the voltage $V_1$ outputted from the voltage amplifier circuit 81, under a measurement condition in which reflected light (diffused reflection light) is not incident on the light receiving element 35 through the opening of the housing 37. Additionally, the microcomputer 83 adjusts the reference voltage $V_{ref1}$ used in the voltage amplifier circuit 81 based on the measured voltage obtained by this measurement. In the present embodiment, such a measurement condition is realized by forming the patch image 70K for K (black) on the intermediate transfer belt 12*a*, and measuring the voltage $V_1$ outputted from the voltage amplifier circuit 81 when light from the LED 33 is irradiated onto this patch image.

If it is possible to adjust the reference voltage $V_{ref1}$ so that the measured voltage of the output voltage $V_1$ of the voltage amplifier circuit 81 ideally becomes 0, it is possible to suppress the influence of unwanted reflected light limitlessly. In the present embodiment, the influence of unwanted reflected light is reduced by adjusting the reference voltage $V_{ref1}$ so that the measured voltage of the output voltage $V_1$ of the voltage amplifier circuit 81 becomes lower than a threshold voltage $V_{th}$. In particular, in later described FIGS. 8B and 10, an example is illustrated in which measurement of the output voltage $V_1$ of the voltage amplifier circuit 81 and adjustment of the reference voltage $V_{ref1}$ is repeated until the measured voltage of $V_1$ becomes lower than the threshold voltage $V_{th}$.

Also, in the present embodiment, the microcomputer 83 adjusts the amplification factor Av of the voltage amplifier circuit 81 to improve the dynamic range for detecting the density or position of an image based on the voltage $V_1$ outputted from the voltage amplifier circuit 81. Specifically, the microcomputer 83 forms the patch image 70K for K and the patch image 70C for another color (C) on the intermediate transfer belt 12*a*, and measures the voltage $V_1$ outputted from the voltage amplifier circuit 81 when light is irradiated from the LED 33 onto respective patch images under the foregoing measurement condition. Additionally, the microcomputer 83 adjusts the amplification factor Av of the voltage amplifier circuit 81 based on the difference between the measured voltage corresponding to the patch image 70K for K and the measured voltage corresponding to the patch image 70C for C obtained by this measurement. In the present embodiment, the dynamic range is improved by adjusting the amplification factor Av so that such a difference between the measured voltages becomes equivalent to a target value $D_{tgt}$ for a dynamic range of the voltage $V_1$ outputted from the voltage amplifier circuit 81.

<Adjustment of Reference Voltage and Amplification Factor>

Below, with reference to FIGS. 7 and 8B, a concrete example of adjustment of the reference voltage $V_{ref1}$ and the amplification factor Av of the above-described voltage amplifier circuit 81 will be described. In the example illustrated in FIG. 8B, the patch image 70K for K and the patch image 70C for C are formed in order on the intermediate transfer belt 12*a*, and the output voltage $V_1$ of the voltage amplifier circuit 81 for when light is irradiated from the LED 33 on each patch image is measured as $V_k$ and $V_c$. The microcomputer 83 adjusts the amplification factor Av and the reference voltage $V_{ref1}$ of the voltage amplifier circuit 81 based on the measured voltages $V_k$ and $V_c$ obtained by measurement.

In the adjustment of the reference voltage $V_{ref1}$, $V_{ref1}$ is decided by gradually changing $V_{ref1}$ until the measured voltage $V_k$ corresponding to the patch image 70K for K becomes lower than the threshold voltage $V_{th}$. Also, in the adjustment of the amplification factor Av, the amplification factor Av is decided so that the difference between the measured voltage $V_k$ corresponding to the patch image 70K for K and the measured voltage $V_c$ corresponding to the patch image 70 for C becomes the same as the target value $D_{tgt}$ for the dynamic range. In the present example, the threshold voltage $V_{th}$ is assumed to be 0.1 [V], and the target value $D_{tgt}$ for the dynamic range is assumed to be 3.0 [V].

Here, similarly to in the example of FIG. 8A, the resistance values $R_0$, $R_1$, and $R_3$ of the resistors 87, 93 and 94, the IV conversion reference voltage $V_{ref0}$, and the reference voltage $V_{ref1}$ of the voltage amplifier circuit 81 are set to $R_0$=2 [MΩ], $R_1$=$R_3$=10 [kΩ], $V_{ref0}$=2.0 [V], and $V_{ref1}$=0.6 [V]. Also, in the resistor arrays 95 and 91, by putting all of the 20 resistors each having 200 [kΩ] in a connected state, the resistance values $R_2$ and $R_4$ of the resistor arrays 95 and 91 are set to $R_2$=$R_4$=10 [kΩ].

In FIG. 8B, similarly to FIG. 8A, the microcomputer 83 first sets $V_{ref1}$ to an initial value (0.6 [V]), and controls the light emitting element driving circuit 85 to cause the LED 33 to emit a predetermined amount of light. The microcomputer 83 causes an emission of the LED 33 to start in advance before the patch image 70K for K which is formed on the intermediate transfer belt 12*a* reaches the light-receivable region 56, and performs, in the state in which the LED 33 emits the predetermined amount of light, measurement of the output voltage $V_1$ of the voltage amplifier circuit 81. In this way, the microcomputer 83 measures the output voltage $V_1$ of the voltage amplifier circuit 81 for when light is irradiated from the LED 33 onto the patch image 70K for K, and obtains the measured voltage $V_k$=0.6 [V]. In this measured voltage, a voltage corresponding to the tiny received light amount of the diffused reflection light from the patch image 70K for K and a voltage corresponding to the received light amount for unwanted reflected light are included.

After that, the microcomputer 83 starts to change $V_{ref1}$ at the timing T1, and gradually changes $V_{ref1}$ (for example, raises by 0.1 [V] at a time) until the timing T2 at which $V_k$ becomes lower than the threshold voltage $V_{th}$ (0.1 [V]). When $V_k$ becomes lower than the threshold voltage $V_{th}$, the microcomputer 83 stores the value of $V_{ref1}$ at that time (assumed to be 1.2 [V] here.) in a storage unit 84. In this way, adjustment of the reference voltage $V_{ref1}$ by the microcomputer 83 completes.

Next, the microcomputer 83 again sets $V_{ref1}$ to an initial value (0.6 [V]), and controls the light emitting element driving circuit 85 to cause the LED 33 to emit a predetermined amount of light. The microcomputer 83 causes an emission of the LED 33 to start in advance before the patch image 70C for C which is formed on the intermediate transfer belt 12*a* reaches the light-receivable region 56, and performs, in the state in which the LED 33 emits the predetermined amount of light, measurement of the output voltage $V_1$ of the voltage amplifier circuit 81. In this way, the microcomputer 83 measures the output voltage $V_1$ of the voltage amplifier circuit 81 for when light is irradiated from the LED 33 onto the patch image 70C for C, and obtains the measured voltage $V_c$=1.2 [V]. In this measured voltage, a voltage corresponding to the received light amount of the diffused reflection light from the patch image 70C for C and a voltage corresponding to the received light amount for unwanted reflected light are included.

After that, the microcomputer 83 calculates the amplification factor Av by the following formula based on the target value $D_{tgt}$ for dynamic range and the measured voltages $V_k$ and $V_c$.

$$Av=D_{tgt}/(V_c-V_k) \quad (5)$$

Here, Av=5 is calculated from $D_{tgt}$=3.0 [V], $V_k$=0.6 [V], and $V_c$=1.2 [V].

FIG. 9 illustrates an example of a table for converting the amplification factor Av into $R_2$ and $R_4$ of the voltage amplifier circuit 81. In the voltage amplifier circuit 81 of the present embodiment, it is possible to realize the corresponding amplification factor Av by setting the resistance value $R_4$ of the resistor array 91 and the resistance value $R_2$ of the resistor array 95 to the values included in the table illustrated in FIG. 9. For example, the microcomputer 83 stores $R_2$=$R_4$=50 [kΩ] corresponding to Av=5 in the storage unit 84. Note that, if the amplification factor Av calculated as described above does not match any of the values included in the table illustrated in FIG. 9, then the amplification factor Av may be approximated by the closest value among the values included in the table. In this way, adjustment of the amplification factor Av by the microcomputer 83 completes.

After adjustment of the reference voltage $V_{ref1}$ and the amplification factor Av completes, the microcomputer 83 sets $V_{ref1}$=1.2 [V], and $R_2$=$R_4$=50 [kΩ] when detection of a position or density of an image is performed. With this, it is possible to perform detection of a position or density of the image based on the output voltage within a range (dynamic range) between a minimum value of 0.1 [V] or less and a maximum value 3.0 [V], which is obtained as the output voltage $V_1$ of the voltage amplifier circuit 81. That is, it is possible to reduce the influence of unwanted reflected light on the light reception result of the light receiving element 35.

<Reference Voltage and Amplification Factor Adjustment Procedure>

Figure 10:
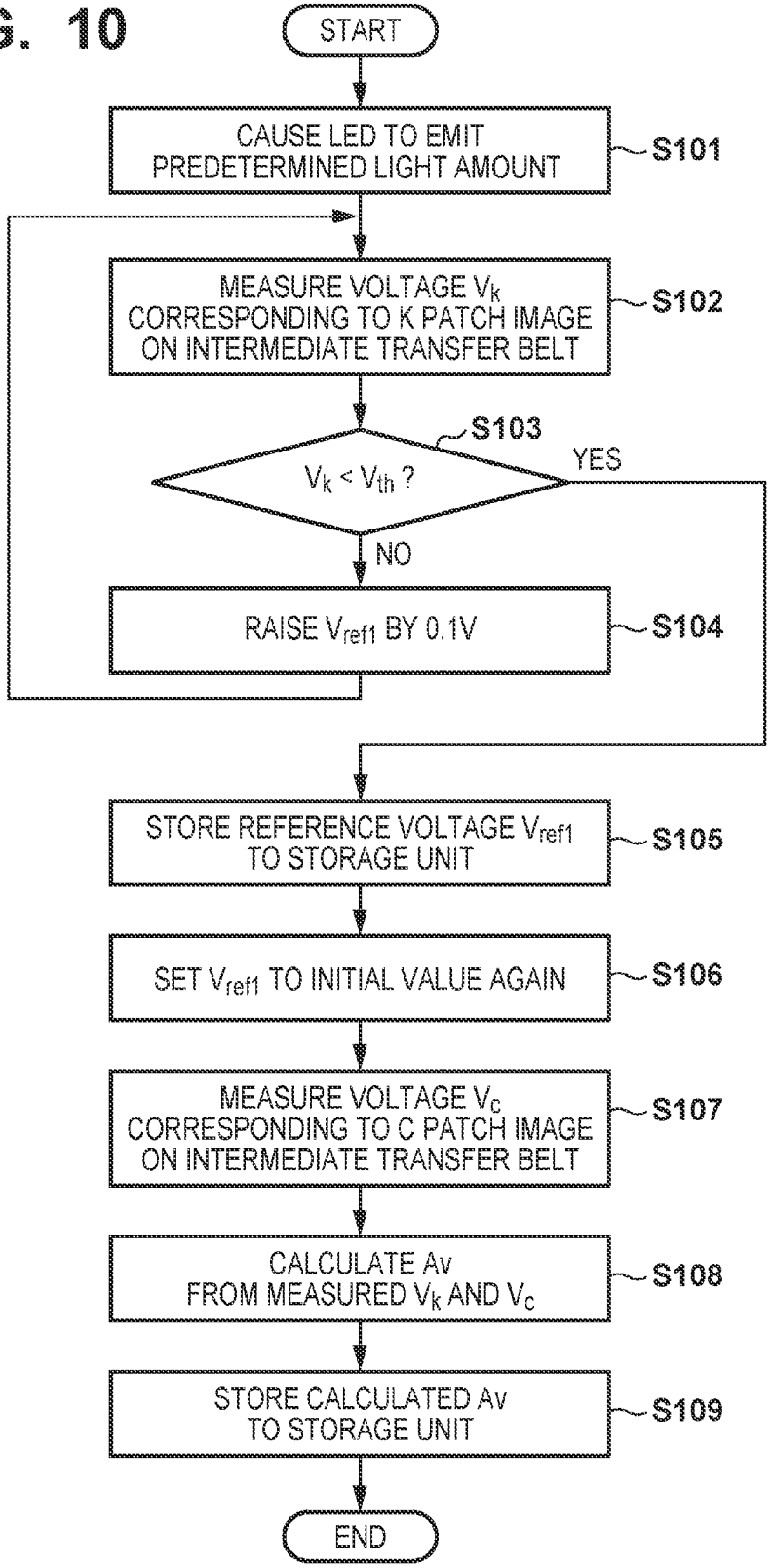
FIG. 10 is a flowchart illustrating a procedure for adjusting a reference voltage and an amplification factor of the voltage amplifier circuit.

Next, a procedure for adjusting the reference voltage $V_{ref1}$ and the amplification factor Av that is executed by the microcomputer 83 will be described with reference to FIG. 10. The microcomputer 83 performs adjustment of the reference voltage $V_{ref1}$ and the amplification factor Av by the following procedure while forming the patch image 70K for K and the patch image 70C for C in order on the intermediate transfer belt 12*a* as described above. Note that it is advantageous that the density of each of the patch image 70K and the patch image 70C formed on the intermediate transfer belt 12*a* be the maximum density.

The microcomputer 83 first in step S101 sets the reference voltage $V_{ref1}$ to an initial value (0.6 [V]), and causes the LED 33 to emit a predetermined amount of light, and in step S102, measures the output voltage $V_k$ of the voltage amplifier circuit 81 for when irradiating light from the LED 33 onto the patch image 70K for K. The microcomputer 83 determines whether or not $V_k$<$V_{th}$ (=0.1 [V]), and if $V_k$<$V_{th}$, advances the processing to step S105, and if not, advances the processing to step S104. In step S104, the microcomputer 83 raises the reference voltage $V_{ref1}$ by 0.1V and returns the processing to step S102. In step S102, the microcomputer 83 measures the output voltage $V_k$ of the voltage amplifier circuit 81 again while the patch image 70K for K passes the light-receivable region 56. In this way, the microcomputer 83 repeats the measurement and the adjustment of the reference voltage $V_{ref1}$ until it determines that $V_k$<$V_{th}$.

When $V_k$<$V_{th}$, the microcomputer 83, in step S105, stores the reference voltage $V_{ref1}$ for that time in the storage unit 84, and in step S106, sets the reference voltage $V_{ref1}$ to the initial value (0.6 [V]) again. After that, in step S107, the microcomputer 83 measures the output voltage $V_c$ of the voltage amplifier circuit 81 for when light is irradiated from the LED 33 onto the patch image 70C for C. Additionally, the microcomputer 83, in step S108, calculates the amplification factor Av from the measured $V_k$ and $V_c$, and stores the calculated amplification factor Av in the storage unit 84, and completes the processing.

In this way, when the adjustment of the reference voltage $V_{ref1}$ and the amplification factor Av completes, the microcomputer 83 may form patch images of each color on the intermediate transfer belt 12*a*, and detect the position or density of the patch images based on the voltage $V_1$ outputted from the voltage amplifier circuit 81. The microcomputer 83 may execute the color misregistration correction control based on to the detected position of the patch image, or execute the image density control based on the detected density of the patch image.

As described above, in the present embodiment, it is possible to reduce the influence of unwanted reflected light that propagates through a light path such as the light path 501 or 502 within the housing 37 of the toner detection unit 31 and is received by the light receiving element 35, by adjusting the reference voltage Vref1 of the voltage amplifier circuit 81. Specifically, the output voltage Vk of the voltage amplifier circuit 81 at the time when light from the LED 33 is irradiated onto the patch image 70K for K is measured, and based on the measurement result, the reference voltage Vref1 is adjusted. With this, it becomes possible to suppress the voltage corresponding to the received light amount for the unwanted reflected light other than the diffused reflection light from the toner image or the intermediate transfer belt 12*a* to close to 0 [V]. As a result, it becomes possible to reduce the influence of the unwanted reflected light on the light reception result of the light receiving element 35, and to thereby improve the detection precision for the position or the density of the image.

Also, in the present embodiment, the amplification factor Av of the voltage amplifier circuit 81 is adjusted based on the difference between the output voltage $V_k$ of the voltage amplifier circuit 81 corresponding to the patch image 70K for K and the output voltage $V_k$ corresponding to the patch image 70C for C. With this, it becomes possible to widen the dynamic range for detecting the position or density of the image to a more suitable range (for example, from a range of 0.4 to 1.2 [V] to a range of approximately 0 to 3.0 [V]). As a result, it becomes possible to improve the detection precision for the position or the density of the image.

Note that in the present embodiment, an example of measuring an output voltage $V_c$ corresponding to the patch image 70C for C is described, but it is also possible to measure the output voltages $V_m$ or $V_y$ for M or Y, that corresponds a patch image other than for C, to perform the adjustment of the amplification factor Av.

Second Embodiment

In the adjustment of the reference voltage $V_{ref1}$ of the first embodiment, $V_{ref1}$ is gradually changed until the measured voltage $V_k$ corresponding to the patch image for K becomes lower than the threshold voltage $V_{th}$. In the present embodiment, adjustment of the reference voltage $V_{ref1}$ is performed by a method different to that of the first embodiment. Below, the present embodiment is described focusing on points of difference with the first embodiment.

<Adjustment of Reference Voltage>

Figure 11:
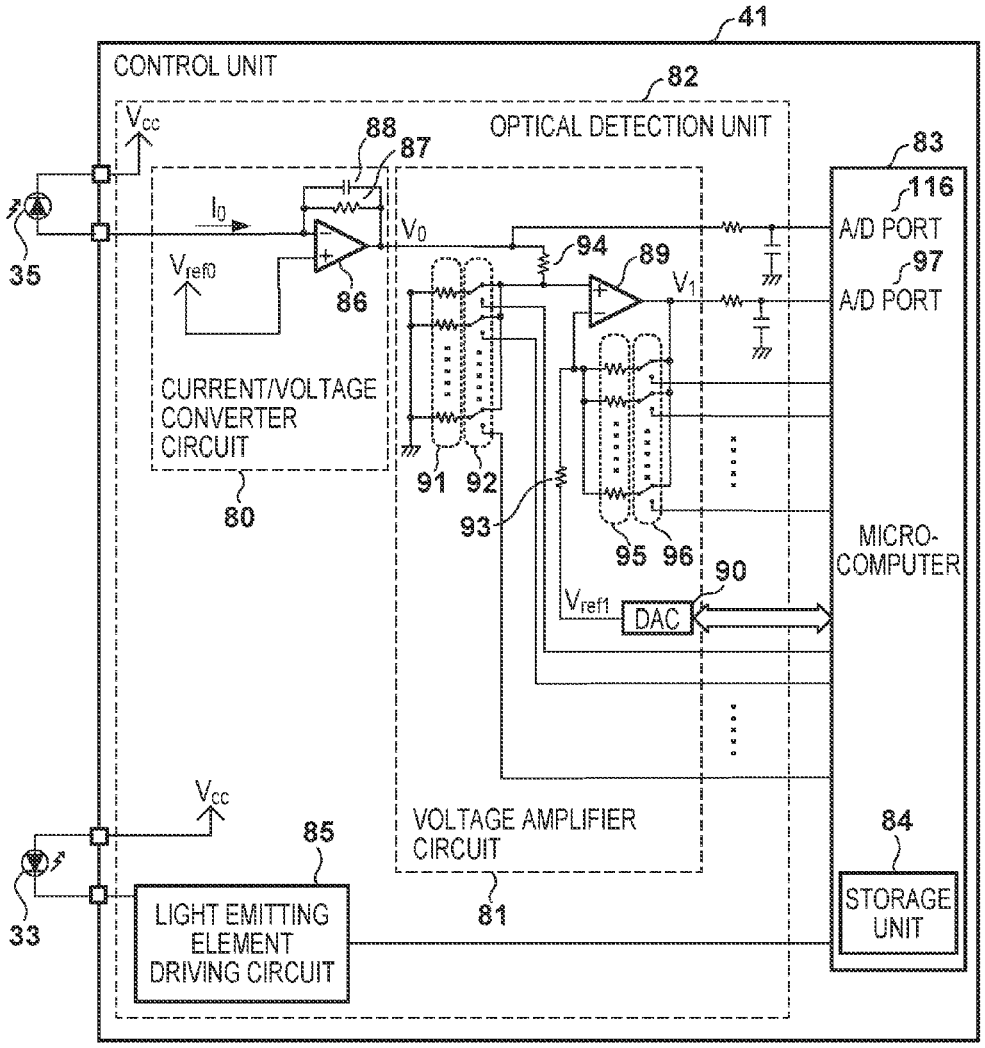
FIG. 11 is a circuit diagram illustrating an example configuration of the control unit.

With reference to FIG. 11, adjustment of the reference voltage $V_{ref1}$ of the voltage amplifier circuit 81 according to the present embodiment will be described below. FIG. 11 is a circuit diagram illustrating an example configuration of the optical detection unit 82 according to the present embodiment which is arranged in the control unit 41 (DC controller). The point of difference with the first embodiment (FIG. 7) is that the current/voltage converter circuit 80 outputs the voltage $V_0$, which is converted from the current outputted from the light receiving element 35, to the microcomputer 83 not only the voltage amplifier circuit 81. The output voltage $V_0$ of the current/voltage converter circuit 80 is inputted into the microcomputer 83 via an A/D port 116 of the microcomputer 83.

In the present embodiment, the microcomputer 83 measures the output voltage $V_0$ from the current/voltage converter circuit 80 under a measurement condition in which reflected light (diffused reflection light) is not incident on the light receiving element 35 through the opening of the housing 37. Additionally, the microcomputer 83, based on the output voltage $V_0$, sets the reference voltage $V_{ref1}$ so that the measured voltage of the output voltage $V_1$ of the voltage amplifier circuit 81 becomes 0. Specifically, with reference to Equation (2), $V_1$ becomes 0 when $V_{ref1}=V_0$. Accordingly, the microcomputer 83 sets the output voltage $V_0$ from the current/voltage converter circuit 80 as the reference voltage $V_{ref1}$ of the voltage amplifier circuit 81.

The foregoing measurement condition can be realized, similarly to in the first embodiment, by forming the patch image 70K for K on the intermediate transfer belt 12*a*, and irradiating light from the LED 33 onto the patch image. Accordingly, the microcomputer 83 forms the patch image 70K for K on the intermediate transfer belt 12*a*, and sets, as the reference voltage $V_{ref1}$, the voltage $V_0$ outputted from the current/voltage converter circuit 80 when the patch image passes through the light-receivable region 56. Note that adjustment of the amplification factor Av of the voltage amplifier circuit 81 may be performed similarly to in the first embodiment.

<Procedure for Adjusting Reference Voltage and Amplification Factor>

Figure 12:
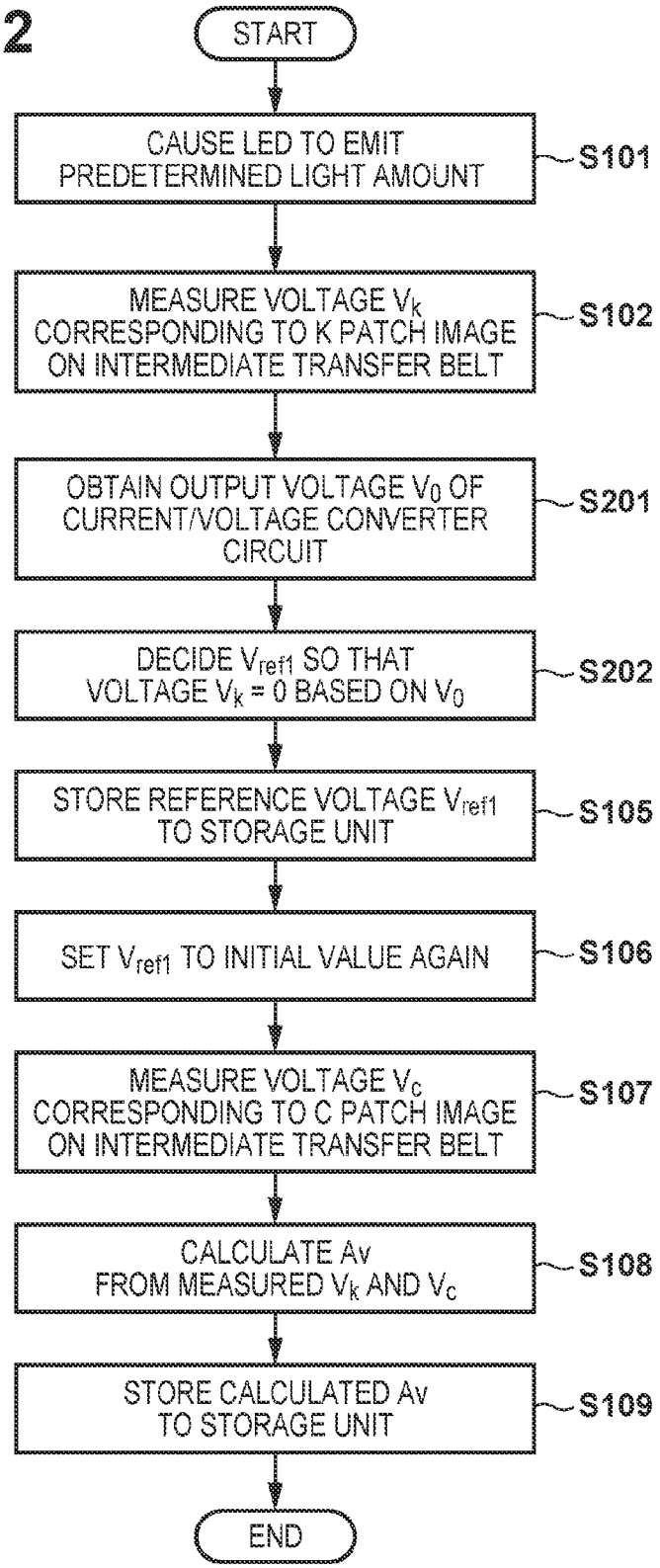
FIG. 12 is a flowchart illustrating a procedure for adjusting a reference voltage and an amplification factor of the voltage amplifier circuit.

Next, a procedure for adjusting the reference voltage $V_{ref1}$ and the amplification factor Av that is executed by the microcomputer 83 will be described with reference to FIG. 12. The microcomputer 83 performs adjustment of the reference voltage $V_{ref1}$ and the amplification factor Av by the following procedure, while forming the patch image 70K for K and the patch image 70C for C in order on the intermediate transfer belt 12*a* as described above. Note that steps for executing processing similar to in the first embodiment (FIG. 11) will be given the same reference numerals.

Step S101 and step S102 are similar to in the first embodiment. In step S201, the microcomputer 83 obtains the output voltage $V_0$ of the current/voltage converter circuit 80 via the A/D port 116. Additionally, in step S202, the microcomputer 83 decides, based on the output voltage $V_0$, the reference voltage $V_{ref1}$ by which the output voltage $V_k$ of the voltage amplifier circuit 81 for when light from the LED 33 is irradiated onto the patch image 70K for K becomes $V_k$=0 [V], as described above. Specifically, the microcomputer 83 decides the reference voltage $V_{ref1}=V_0$. Step S105 to step S109 thereafter are similar to in the first embodiment.

As described above, in the present embodiment, the reference voltage $V_{ref1}$ of the voltage amplifier circuit 81 is set from the output voltage $V_0$ of the current/voltage converter circuit 80 for when light from the LED 33 is irradiated onto the patch image 70K for K. With this, similarly to in the first embodiment, it becomes possible to suppress the voltage corresponding to the received light amount for unwanted reflected light other than the diffused reflection light from the toner image or the intermediate transfer belt 12*a* to close to 0 [V]. As a result, it becomes possible to reduce the influence of the unwanted reflected light on the light reception result of the light receiving element 35 and to thereby improve the detection precision for the position or the density of the image.

Third Embodiment

In the third embodiment, measurement of the output voltage $V_1$ of the voltage amplifier circuit 81 is performed under a measurement condition different to that of the first and a second embodiment. Specifically, measurement of the voltage $V_1$ is performed in a state in which diffused reflection light from the intermediate transfer belt 12*a* is not incident on the light receiving element 35 through the opening of the housing 37 prior to the intermediate transfer belt 12*a* being embedded in the image forming apparatus 100 in the manufacturing process of the image forming apparatus 100. Below, the present embodiment is described focusing on points of difference with the first embodiment.

Adjustment of the reference voltage $V_{ref1}$ in the first and second embodiments is performed in a user operating environment after manufacture of the image forming apparatus 100. In the present embodiment, the output voltage $V_1$ of the voltage amplifier circuit 81 is measured, the reference voltage $V_{ref1}$ is adjusted, and $V_{ref1}$ after the adjustment is stored in the storage unit 84 in the manufacturing process of the image forming apparatus 100. The measurement of the voltage $V_1$ is performed in a state in which the intermediate transfer belt unit 12 is removed from the image forming apparatus 100, that is in a state prior to the intermediate transfer belt 12*a* being embedded in the image forming apparatus 100. In this state, even if the LED 33 is caused to emit light, diffused reflection light from the intermediate transfer belt 12*a* is not incident on the light receiving element 35, and the light receiving element 35 only receives the unwanted reflected light. In this way, it is possible to perform the measurement of the voltage $V_1$ in a state in which the diffused reflection light from the intermediate transfer belt 12*a* is not incident on the light receiving element 35 through the opening of the housing 37.

Note that in a case where the light from the LED 33 is reflected in the image forming apparatus 100 and is incident on the light receiving element 35, or in a case where the interior of the image forming apparatus 100 is bright due to disturbance light, for example, the toner detection unit 31 may be enclosed by a component such as a black box for absorbing light.

It is possible to perform the adjustment of the reference voltage $V_{ref1}$ based on the measurement result of the output voltage $V_1$ of the voltage amplifier circuit 81 similarly to in the first and a second embodiment. The reference voltage $V_{ref1}$ after the adjustment is stored in the storage unit 84. When the microcomputer 83 forms the patch image on the intermediate transfer belt 12*a* and performs detection of the density or position of the image, it uses the reference voltage $V_{ref1}$ stored in the storage unit 84 similarly to in the first and second embodiments.

As described above, in the present embodiment, the reference voltage $V_{ref1}$ of the voltage amplifier circuit 81 is adjusted at a time of manufacture of the image forming apparatus 100. With this, similarly to in the first and second embodiments, it becomes possible to suppress the voltage corresponding to the received light amount for unwanted reflected light other than the diffused reflection light from a toner image or the intermediate transfer belt 12*a* to close to 0 [V]. As a result, it becomes possible to reduce the influence of the unwanted reflected light on the light reception result of the light receiving element 35, and to thereby improve the detection precision for the position or the density of the image.

Other Embodiments

In the foregoing first through third embodiments, examples are described in which, if the unwanted reflected light is incident on the light receiving element 35 for receiving diffused reflection light, the influence of the unwanted reflected light is reduced by adjusting the reference voltage $V_{ref1}$ (and the amplification factor Av) of the voltage amplifier circuit 81. However, the above described embodiments can be similarly applied in cases in which unwanted reflected light that arises in the housing 37 as described above is incident on the light receiving element 34 for receiving specular reflection light. In such cases, circuits similar to the current/voltage converter circuit 80 and the voltage amplifier circuit 81 are arranged for the light receiving element 34 within the optical detection unit 82. The microcomputer 83 may cause the LED 33 to emit light and execute the measurement of the voltage $V_1$ which is outputted from the voltage amplifier circuit under a measurement condition in which reflected light (specular reflection light) is not incident on the light receiving element 34 through the opening of the housing 37, and adjust the reference voltage $V_{ref1}$ of the voltage amplifier circuit. Note that it is possible to perform an adjustment of the amplification factor Av of the voltage amplifier circuit similarly to in the above described embodiments. In this way, it becomes possible to reduce the influence of the unwanted reflected light on the light reception result of the light receiving element 34 and to thereby improve the detection precision for density and position of an image using the light receiving element 34 similarly to in the foregoing embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-218800, filed Nov. 6, 2015, which is hereby incorporated by reference herein in its entirety.

What is claimed is:

1. An image forming apparatus, comprising:

an image carrier that is rotated;

an optical sensor comprising:

a light emitting element that irradiates light towards the image carrier, a light receiving element that outputs current in accordance with a received light amount, and a housing that is configured to form a common opening that is an opening for determining an irradiation region of light irradiated from the light emitting element to the image carrier, and is the opening through which the light irradiated from the light emitting element passes and through which reflected light from the image carrier to be received by the light receiving element passes;

a converter circuit configured to convert the current outputted from the light receiving element into a voltage and to output the voltage;

an amplifier circuit configured to amplify a difference between the voltage outputted from the converter circuit and a reference voltage, and to output the difference as a voltage corresponding to the received light amount; and a control unit configured to execute a measurement of the voltage outputted from the amplifier circuit by causing the light emitting element to emit light, under a measurement condition under which the reflected light is not incident on the light receiving element through the common opening, and to adjust the reference voltage used in the amplifier circuit based on a measured voltage obtained by the measurement.

2. The image forming apparatus according to claim 1, wherein the control unit adjusts the reference voltage so that the measured voltage becomes lower than a threshold voltage.

3. The image forming apparatus according to claim 2, wherein the control unit repeats the measurement and the adjustment of the reference voltage until the measured voltage becomes lower than the threshold voltage.

4. The image forming apparatus according to claim 1, wherein the converter circuit outputs the voltage converted from the current outputted from the light receiving element to the amplifier circuit and the control unit, and the control unit sets the voltage outputted from the converter circuit as the reference voltage so as to cause the measured voltage to approach 0.

5. The image forming apparatus according to claim 1, further comprising an image formation unit configured to form an image on the image carrier, wherein the control unit causes the image formation unit to form a first patch image of black on the image carrier, and measures the voltage outputted from the amplifier circuit when light from the light emitting element is irradiated on the first patch image.

6. The image forming apparatus according to claim 5, wherein the housing is configured to guide, to the light receiving element, a diffused reflection light from a particular region within the irradiation region which is on the image carrier and onto which light from the light emitting element is irradiated, and the control unit measures the voltage outputted from the amplifier circuit when the first patch image formed on the image carrier passes through the particular region.

7. The image forming apparatus according to claim 6, further comprising a detection unit configured to, when the adjustment by the control unit is completed, cause the image formation unit to form a patch image on the image carrier, and detect a position or a density of the patch image based on the voltage outputted from the amplifier circuit.

8. The image forming apparatus according to claim 7, further comprising an execution unit configured to either execute a color misregistration correction control based on the position of the patch image detected by the detection unit, or execute an image density control based on the density of the patch image detected by the detection unit.

9. The image forming apparatus according to claim 5, wherein the housing is configured to guide, to the light receiving element, a specular reflection light from a particular region within the irradiation region which is on the image carrier and onto which light from the light emitting element is irradiated, and the control unit measures the voltage outputted from the amplifier circuit when the first patch image formed on the image carrier passes through the particular region.

10. The image forming apparatus according to claim 5, wherein the control unit further causes the image formation unit to form a second patch image of a different color than the first patch image on the image carrier, and measures the voltage outputted from the amplifier circuit when light from the light emitting element is irradiated on the second patch image, and adjusts an amplification factor of the amplifier circuit based on a difference between the measured voltage corresponding to the first patch image and the measured voltage corresponding to the second patch image.

11. The image forming apparatus according to claim 10, wherein the control unit adjusts the amplification factor so that the difference between the measured voltage corresponding to the first patch image and the measured voltage corresponding to the second patch image becomes equivalent to a target value for a dynamic range of the voltage outputted from the amplifier circuit.

12. The image forming apparatus according to claim 11, wherein the target value is determined as a dynamic range for detecting a position or a density of an image based on the voltage outputted from the amplifier circuit.

13. The image forming apparatus according to claim 1, wherein the control unit measures the voltage outputted from the amplifier circuit when the light emitting element is caused to emit light, in a state in which the reflected light from the image carrier is not incident on the light receiving element through the common opening prior to the image carrier being embedded in the image forming apparatus in a manufacturing process of the image forming apparatus.

14. An image forming apparatus, comprising:

an image carrier that is rotated;

an optical sensor comprising:

a light emitting element that irradiates light towards the image carrier, a light receiving element that outputs current in accordance with a received light amount, and a housing that is configured to form a common opening that is an opening for determining an irradiation region of light irradiated from the light emitting element to the image carrier, and is the opening through which the light irradiated from the light emitting element passes and through which light to be received by the light receiving element passes;

a converter circuit configured to convert the current outputted from the light receiving element into a voltage and to output the voltage;

an amplifier circuit configured to amplify a difference between the voltage outputted from the converter circuit and a reference voltage, and to output the difference as a voltage corresponding to the received light amount;

an image formation unit configured to form a first patch image of black and a second patch image of a different color than the first patch image on the image carrier; and a control unit configured to adjust an amplification factor of the amplifier circuit based on a measured voltage, for the voltage outputted from the amplifier circuit, that corresponds to the first patch image and the measured voltage that corresponds to the second patch image.

15. An image forming apparatus, comprising:

an image carrier that is rotated;

an optical sensor comprising:

a light emitting element that irradiates light towards the image carrier, a light receiving element that outputs an output value in accordance with a received light amount, and a housing that is configured to form a common opening that is an opening for determining an irradiation region of light irradiated from the light emitting element towards the image carrier, and is the opening through which the light irradiated from the light emitting element passes and through which reflected light from the image carrier to be received by the light receiving element passes; and a control unit configured to, based on a first output value outputted from the light receiving element by causing the light emitting element to emit light under a first measurement condition under which the reflected light is not incident on the light receiving element through the common opening, adjust a reference voltage for correcting a second output value outputted from the light receiving element by causing the light emitting element to emit light under a second measurement condition under which the reflected light is incident on the light receiving element through the common opening.

* * * * *